US007332987B2

(12) United States Patent
Wada et al.

(10) Patent No.: US 7,332,987 B2
(45) Date of Patent: Feb. 19, 2008

(54) MULTIMODE DIELECTRIC RESONATOR DEVICE, DIELECTRIC FILTER, COMPOSITE DIELECTRIC FILTER AND COMMUNICATION APPARATUS

(75) Inventors: Takaya Wada, Kyoto (JP); Jun Hattori, Takatsuki (JP)

(73) Assignee: Murata Manufacturing Co., Ltd. (JP)

( * ) Notice: Subject to any disclaimer, the term of this patent is extended or adjusted under 35 U.S.C. 154(b) by 244 days.

(21) Appl. No.: 10/540,758

(22) PCT Filed: Jan. 20, 2004

(86) PCT No.: PCT/JP2004/000409

§ 371 (c)(1),
(2), (4) Date: Dec. 1, 2005

(87) PCT Pub. No.: WO2004/066430

PCT Pub. Date: Aug. 5, 2004

(65) Prior Publication Data

US 2006/0139127 A1 Jun. 29, 2006

(30) Foreign Application Priority Data

Jan. 24, 2003 (JP) ..... 2003-015906

(51) Int. Cl.
*H01P 7/10* (2006.01)
*H01P 1/20* (2006.01)

(52) U.S. Cl. ..... 333/202; 333/219.1

(58) Field of Classification Search ..... 333/202, 333/219.1

See application file for complete search history.

(56) References Cited

U.S. PATENT DOCUMENTS 5,895,652 A 4/1999 Giampapa
6,258,846 B1 7/2001 Hermelin et al.
6,518,857 B1 * 2/2003 Hattori et al. ..... 333/134

FOREIGN PATENT DOCUMENTS

| | | |
|---|---|---|
| EP | 1 104 043 A1 | 5/2001 |
| JP | H11-145704 | 5/1999 |
| JP | 2001-156511 | 6/2001 |

OTHER PUBLICATIONS

The PCT/ISA/210 (with Translation), PCT/ISA/220, and PCT/ISA/237 (with Translation) forms issued for the Parent PCT application.
Zeisel et al., "Choline, an Essential Nutrient for Humans", FASEB J., vol. 5, No. 7, pp. 2093-2098 (1991).

* cited by examiner

*Primary Examiner*—Stephen E. Jones
(74) *Attorney, Agent, or Firm*—Dickstein, Shapiro, LLP.

(57) ABSTRACT

Two TE modes whose electric-field rotating planes have a perpendicular relationship are coupled independently of the coupling between two TM modes whose electric-field directions have the same respective perpendicular relationships. In a multimode dielectric resonator device producing four modes: TM01δ_x mode, TM01δ_y mode, TE01δ_x mode, and TE01δ_y mode, protrusions (Pe1), (Pe2) are disposed on an upper-layer (La) and a lower-layer of a dielectric core (1) to cause a difference in effective dielectric constants of individual parts through which even-mode and odd-mode electric flux of the TE coupling modes passes. A protrusion (Pc) is formed on a middle-layer Lb of the dielectric core (1) such that the effective dielectric constants of the parts through which even-mode and odd-mode electric flux of the TM coupling modes pass become substantially equal. Thereby, the TE01δ_x mode and TE01δ_y mode are coupled while restraining the coupling of the TM01δ_x mode and the TM01δ_y mode.

18 Claims, 22 Drawing Sheets

TM01 δ_x mode

TM01 δ_x mode

TE01 δ_y mode

TM01 δ_y mode

TE01 δ_x mode

——— Electric field

-------- Magnetic field

MULTIMODE DIELECTRIC RESONATOR DEVICE, DIELECTRIC FILTER, COMPOSITE DIELECTRIC FILTER AND COMMUNICATION APPARATUS

TECHNICAL FIELD

This invention relates to a dielectric resonator device operating in a multimode, and a dielectric filter, a composite dielectric filter and a communication apparatus which include the same.

BACKGROUND ART

Previously, Japanese Unexamined Patent Application Publication No. 11-145704 has disclosed a multimode dielectric resonator device having a dielectric core disposed in a cavity and using a plurality of TM modes and TE modes.

In this multimode dielectric resonator device, when coupling is performed between predetermined modes by the shape of the dielectric core, perturbation on an electric field is performed by providing a groove or a hole at a portion on which electric fields to be coupled are concentrated in order to exchange energy between the resonance modes, thereby the coupling is performed.

However, in a known multimode dielectric resonator device, there has been a problem in that coupling is also produced between one TM mode and another TM mode at the same time even if the shape of the dielectric core is determined only by paying attention to the portion on which two modes of electric fields to be coupled are concentrated in order to perform the coupling between the TE mode and the TE mode.

For example, when coupling is performed between an TM01δ_x mode in which an electric field is rotated in a plane perpendicular to an x-axis and an TM01δ_y mode in which an electric field is rotated in a plane perpendicular to a y-axis in an x-y-z rectangular Cartesian coordinate system, a groove and a hole are provided at the portions through which the electric flux of an even mode and an odd mode, which are a coupling mode of both modes, pass in order to make a difference between the resonant frequencies of the even mode and the odd mode. Thereby, it is possible to couple the two TE modes described above with each other.

However, the groove and the hole described above cause perturbation to arise between an TM01δ-x mode in which an electric field is directed in an x direction and an TM01δ-y mode in which an electric field is directed in a y direction, and thus these two TM modes are coupled with each other. That is to say, in a multimode dielectric resonator using both the TM mode and the TE mode, when the coupling between the TE mode and the TE mode is performed, the coupling between the TM modes is also caused to arise, and thus it is difficult to independently determine the amount of coupling between the TE mode and the TE mode.

Also, if a dielectric core is provided with a groove or has a shape with a protruding part in order to perform coupling between the TE mode and the TE mode, the shape of the electric flux distribution is disarranged. As a result, the frequency of the basic mode increases or decreases. Thus, there has been a problem in that when a filter is constructed by coupling a plurality of resonant modes in sequence, the difficulty in adjusting the filter characteristics thereof increases.

Accordingly, an object of this invention is to provide a multimode dielectric resonator device which couples two TE modes, whose electric-field rotating planes have a perpendicular relationship, independently of the coupling between two TM modes whose electric-field directions have the same perpendicular relationships, respectively.

Also, another object of this invention is to couple the TE modes themselves while avoiding coupling of the TM modes having the relationship described above and to provide a multimode dielectric resonator device equipped with four-stage resonators of TM-mode-TE-mode-TE-mode-TM-mode by coupling the TM mode and the TE mode of the one side and coupling the TM mode and the TE mode of the other side, and furthermore another object of this invention is to provide a dielectric filter, a composite dielectric filter, and a communication apparatus including the above-described device.

DISCLOSURE OF INVENTION

According to this invention, there is provided a multimode dielectric resonator device having a dielectric core disposed in a cavity, for producing a first TM01δ mode or TM011 mode having an electric field directed in a first direction, a second TM01δ mode or TM011 mode having an electric field directed in a second direction perpendicular to the first direction, a first TM01δ mode having an electric field rotated in a plane perpendicular to the first direction, and a second TM01δ mode having an electric field rotated in a plane perpendicular to the second direction, respectively, wherein the effective dielectric constants of individual dielectric core portions having electric flux of an even-mode and an odd-mode of TE coupling mode in the first and the second TM01δ modes passing through are different from each other, and the effective dielectric constants of individual dielectric core portions having electric flux of an even-mode and an odd-mode of TM coupling mode in the first and the second TM01δ mode or TM011 mode passing through are substantially equal.

Accordingly, a difference in frequency arises between the even-mode and the odd-mode, which are two coupling modes of the first and the second TM01δ modes, and thus the first and the second TM01δ modes are coupled. Also, no difference in frequency arises between the even-mode and the odd-mode, which are two coupling modes of the first and the second TM01δ modes or TM011 modes, and thus the first and the second TM01δ modes or TM011 modes are not coupled with each other. That is to say, the coupling between the first and the second TM01δ modes can be set independently from the coupling of TM01δ or TM011 modes.

Also, in this invention, there is provided a difference in the amount of protrusion or the amount of subsidence in the dielectric core portions having electric flux passing therethrough with regard to the even mode and odd mode of the TE coupling mode, and a subsidence or protrusion for canceling frequency changes of the even mode and the odd mode of the TM coupling mode, by said difference of the amount of the protrusion or the amount of the subsidence, is disposed on the dielectric core portion of said TE coupling mode having a relatively small electric flux density.

With this structure, a frequency change in the even mode and the odd mode of the TM coupling mode, which arises by the difference in the amount of protrusion or the amount of subsidence of the dielectric core disposed on the position having a high electric flux density of the TE coupling mode, is canceled, and thus the coupling between the first and the second TM01δ modes or TM011 modes can be prevented.

Also, there is provided according to this invention a multimode dielectric resonator device equipped with four-stage resonators having a first TM01δ mode or TM011 mode, a first TM01δ mode, a second TM01δ mode, and a second TM01δmode or TM011 mode by coupling the first and the second TM01δ modes with the first and the second TM01δ modes or TM011 modes, respectively, by displacing a center of electric flux density distribution of the first and the second TM01δ modes or the first and the second TM011 modes upward or downward in planes perpendicular to the directions of the electric fields of the first and the second TM01δ modes or the first and the second TM011 modes.

In this manner, the first and the second TM01δ modes or TM011 modes and the first and the second TM01δ modes are coupled, respectively, by displacing a center of electric flux density distribution of the first and the second TM01δ modes or the first and the second TM011 modes upward or downward in planes perpendicular to the directions of the electric fields of the first and the second TM01δ modes or the first and the second TM011 modes. At this time, the coupling does not arise between the first and the second TM01δ modes or the TM011 modes themselves, and thus an operation is performed as four-stage resonators in which the first TM01 mode or TM011 mode→the first TE01δ mode→the second TE01δ mode→the second TM01δ mode or TM011 mode are coupled in sequence.

Also, according to this invention, there is provided a dielectric filter including: a multimode dielectric resonator device operating as four-stage resonators described above; and external coupling means for external coupling in the first-stage and the last-stage resonators, respectively, of the four-stage resonators.

Thereby, a filter including a band-pass characteristic including four-stage resonators operation is performed.

Also, there is provided according to this invention a composite dielectric filter including two sets of the dielectric filters described above, sharing one of the external coupling means of each of the dielectric filters.

For example, an operation is performed as a transmitter/receiver by using one of the filters as a transmission filter, the other of the filters as a reception filter, and the shared external coupling means as an antenna port.

Also, according to this invention, there is provided a communication apparatus equipped with the above-described dielectric filter or composite dielectric filter in its high-frequency circuit portion.

BEST MODE FOR CARRYING OUT THE INVENTION

A description will be given of a multimode dielectric resonator device according to a first embodiment with reference to FIGS. 1 to 10.

The material of the dielectric core disposed in the devices shown in each embodiment including this first embodiment is selected in accordance with the frequency band used for the device. For example, a selection is made from groups including zirconium titanate-stannum titanate series compounds, rare-earth barium titanate series compounds, barium titanate series compounds, zinc barium tantalate series compounds, magnesium barium tantalate series compounds, rare earth aluminate-calcium titanate series compounds, magnesium titanate-calcium titanate series compounds. The relative dielectric constant at this time has an arbitrary value between 20 to 130. A zirconium titanate-stannum titanate compound having a relative dielectric constant of 38 is used in this first embodiment and the other embodiments shown subsequently.

FIGS. 1A to 1D are perspective views showing a dielectric core disposed in a cavity and the shapes of four resonant modes to be used. A solid-line arrow in the figure indicates a line of electric force and a broken-line arrow indicates a line of magnetic force. FIG. a(A) is the TM01δ_x mode which is the first TM01δ mode, FIG. 1(B) the TE01δ_y mode, which is the first TE01δ mode, FIG. 1(C) the TE01δ_x mode, which is the second TE01δ mode, and FIG. 1(D) the TM01δ_y mode, which is the second TM01δ mode, each of which shows the electromagnetic filed distributions using lines of electric force and lines of magnetic force.

Figure 1A:
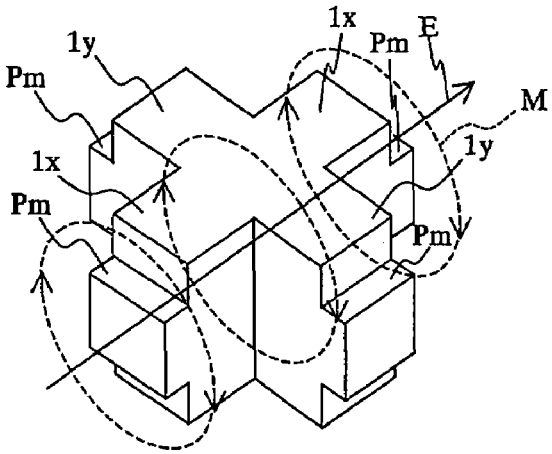
FIGS. 1A to 1D are diagrams illustrating directions of electric flux and magnetic flux of four resonant modes in the multimode dielectric resonator device according to a first embodiment.
Figure 1B:
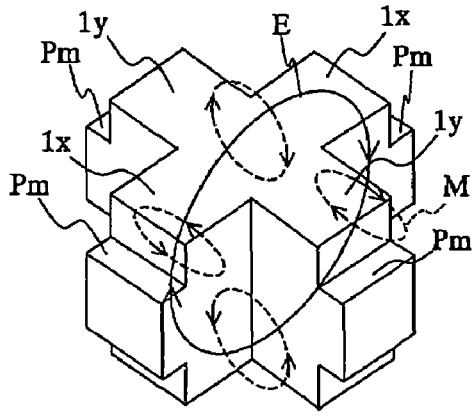
Figure 1C:
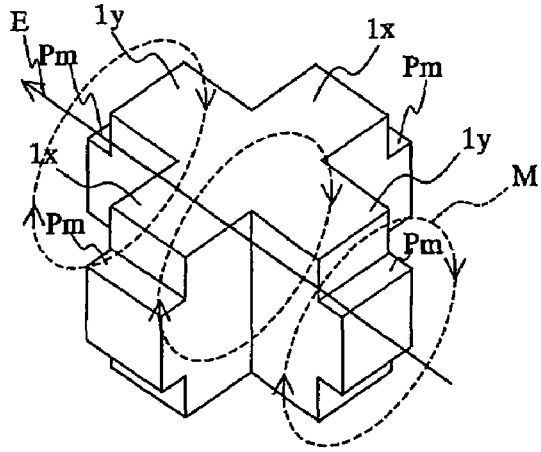
Figure 1D:
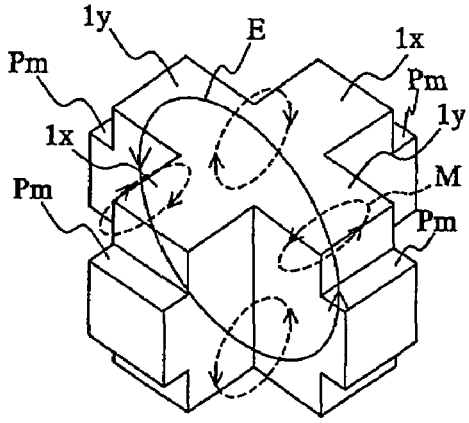
Figure 1D:
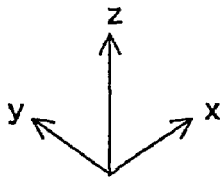
Figure 2A:
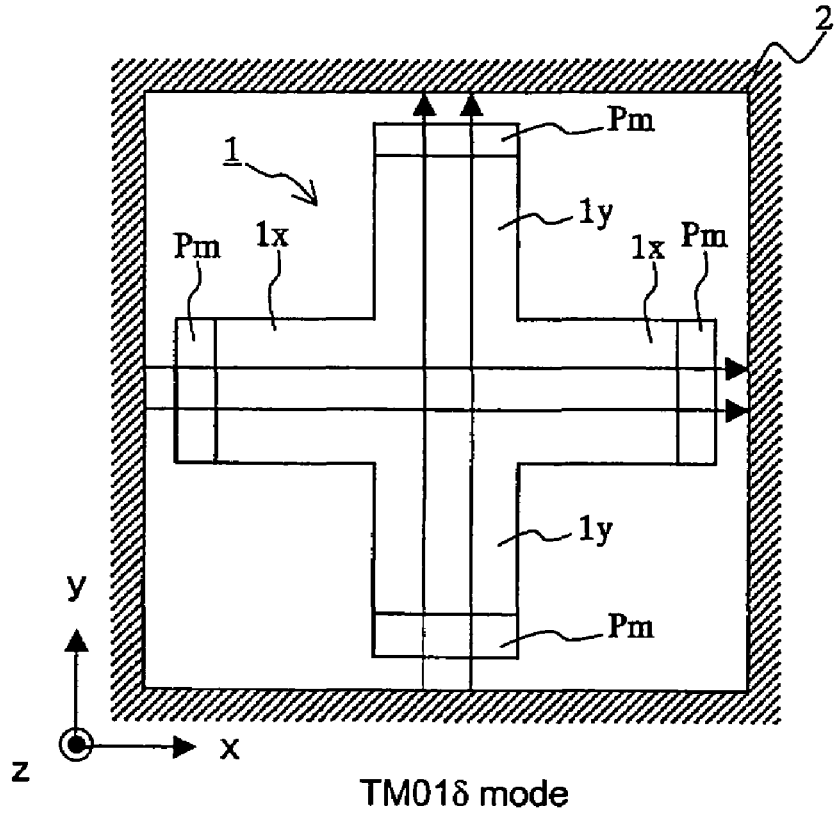
FIGS. 2A and 2B are diagrams illustrating directions of the passing electric flux of each mode of the same dielectric resonator device.
Figure 2B:
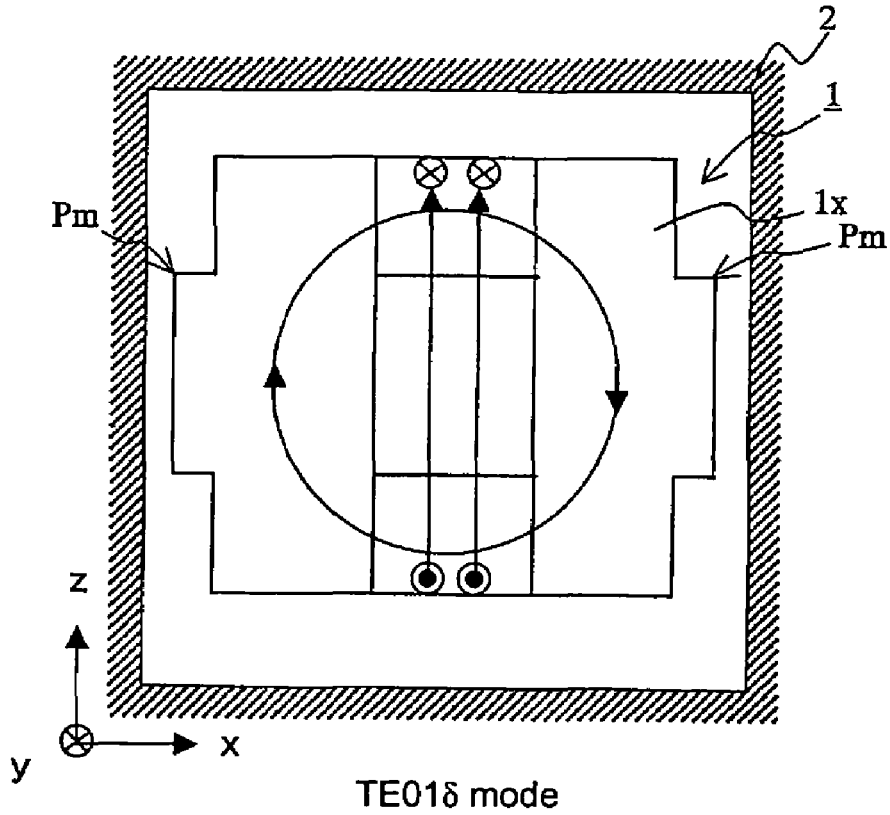

FIGS. 2A and 2B shows electric flux density distribution of the four modes, including the cavity. In these figures and also in FIGS. 3 and 10-19, (A) is a view seen from z-axis direction and (B) is a view seen from y-axis direction. Also, the solid-line arrow indicates a line of electric force. In this manner, a dielectric core 1 is disposed inside cavity 2 having a substantially cubic shape.

In the TM01δ_x mode, an electric field is directed in the x direction and a magnetic field rotates in a plane parallel to the y-z plane. In this TM01δ_x mode, an electric field is mainly concentrated onto the 1x part, that is, an x-direction part of the dielectric core. The TM01δ_y mode is at a 90° rotated from the TM01δ_x mode around the z-axis. That is to say, an electric field is directed in the y direction and a magnetic field rotates in a plane parallel to the x-z plane which is perpendicular to the electric field. In this TM01δ_y mode, an electric field is mainly concentrated onto the 1y part, that is, an y-direction part of the dielectric core.

In the TM01δ_y mode, an electric field rotates in a plane perpendicular to the y direction. In this TM01δ_y mode, an electric field is mainly concentrated onto the 1x part, that is, an x-direction part of the dielectric core. The TM01δ_x mode is at a 90° rotated from the TM01δ_y mode around the z-axis. That is to say, an electric field rotates in a plane perpendicular to the x direction. In this TM01δ_x mode, an electric field is mainly concentrated onto the 1y part, that is, a y-direction part of the dielectric core.

The portion denoted as "Pm" of the dielectric core 1 is a protrusion protruding from the dielectric core 1 toward the inner surface of the cavity 2. The electric flux of the TM mode passes mainly through a capacity portion created between the end face of this dielectric core protrusion Pm and the inner surface of the cavity 2. That is to say, the resonant frequency of the TM mode is determined by the capacity created between the end face of this dielectric core protrusion Pm and the inner surface of the cavity 2. Also, independence of the electric flux of the TM mode passing inside the dielectric core 1 is increased.

As described in detail below, when the TM01δ_y mode and the TM01δ_x mode are coupled, the coupling between the TM01δ_x mode and the TM01δ_y mode occurs simultaneously in accordance with it.

Figure 4:
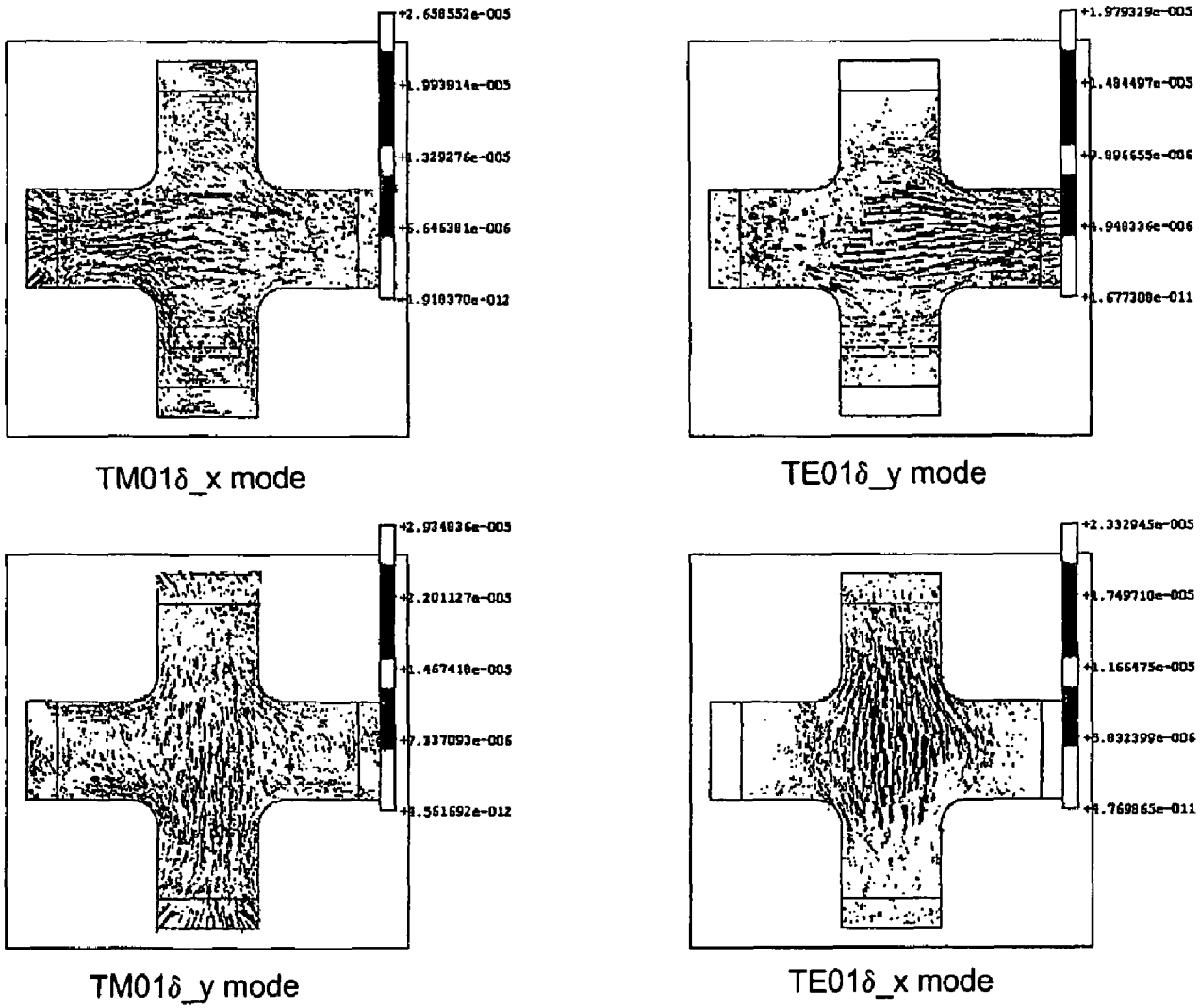
FIG. 4 is a diagram illustrating examples of the distribution of electric flux densities in the four resonant modes.

FIG. 4 shows examples in which electric flux densities of said four resonant modes are obtained by simulation. In this manner, in the TM01δ_x mode, electric flux runs from the inner surface of the cavity near one end face of the x-direction portion 1x of the dielectric core to the inner surface of the cavity near the other end face.

Figure 3A:
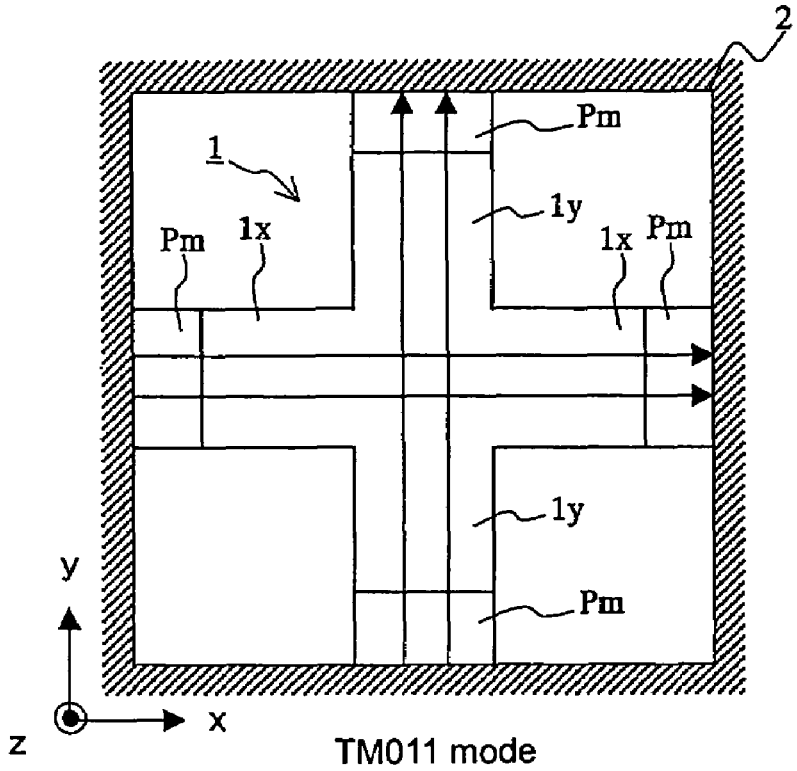
FIGS. 3A and 3*b* are diagrams illustrating directions of the passing electric flux of each mode in a state in which a dielectric core 1 is contacted with the inner surface of a cavity 2.
Figure 3B:
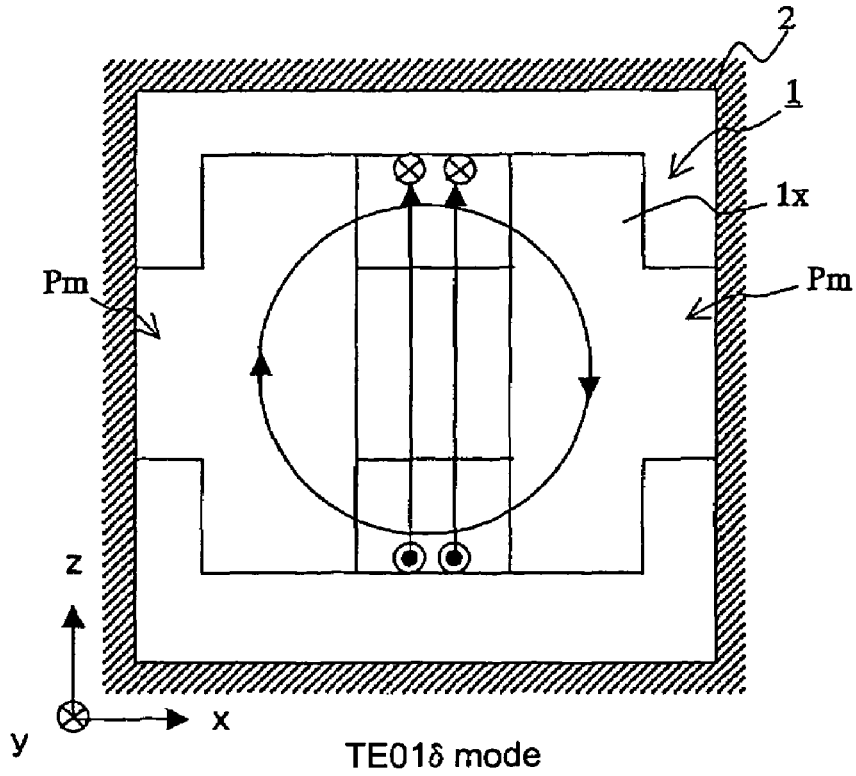

FIG. 3 is an example using another dielectric core 1. Here, (A) is a view seen from the z-axis direction and (B) is a view seen from the y-axis direction. In the examples shown in FIGS. 2 and 4, the TM01δ_x mode and the TM01δ_y mode are produced by setting the end faces of the four sides of the dielectric core 1 apart from the inner surface of the cavity 2. However, as shown in FIG. 3, if the end faces of the four sides of the dielectric core 1 are set in contact with the inner surface of the cavity 2, it can be operated as a TM011x mode and a TM011y mode.

Figure 5:
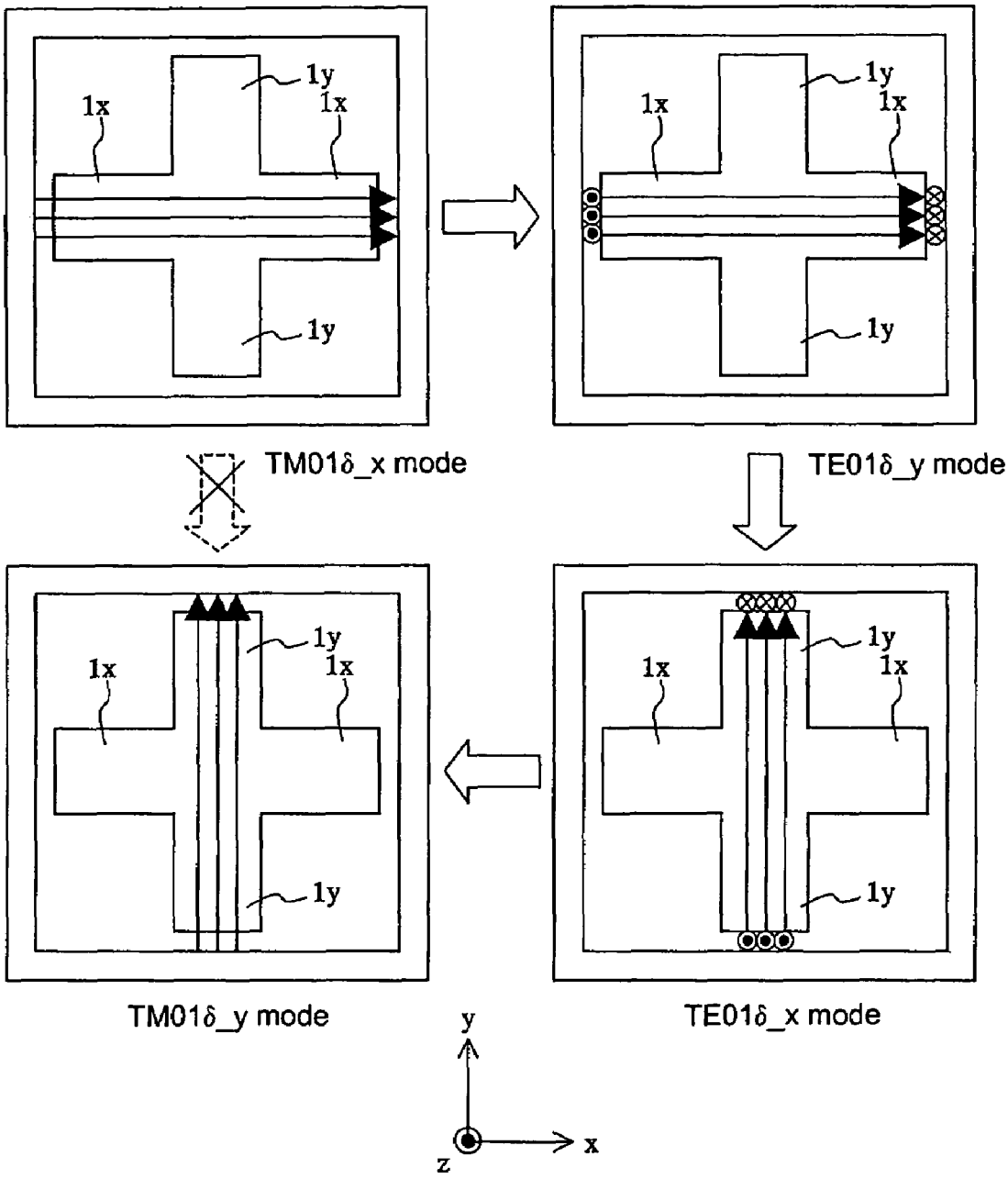
FIG. 5 is a diagram illustrating a coupling sequence of the four resonant modes.

FIG. 5 shows a coupling sequence of the four resonant modes described above. In this example, the TM01δ_x mode and the TM01δ_y mode are coupled, the TM01δ_y mode and the TM01δ_x mode are coupled, and further the TM01δ_x mode and the TM01δ_y mode are coupled. Also, at the same time, the coupling between the TM01δ_x mode and the TM01δ_y mode is caused not to occur.

Next, a structure for coupling the TE01δ_y mode and the TE01δ_x mode without producing the coupling between the TM01δ_x mode and the TM01δ_y mode is shown in FIGS. 6. Here, FIG. 6(D) is a side view seen in the y-axis direction, 6(A) is a sectional view seen on A-A part, 6(B) is a sectional view taken on B-B part, and 6(C) is a sectional view seen on C-C part. The dielectric core 1 basically has a three-layer structure. (A), (B), and (C) are sectional views taken on an upper layer La, a middle layer Lb, and a lower layer Lc, respectively. In the upper layer La part, as shown in 6(A), protrusions Pe1 of the dielectric core protruding in the direction of x+y (in the direction having a direction angle of 45° assuming that the x direction is 0 degree) and in the direction of −(x +y) (in the direction having a direction angle of −135° assuming that the x direction is 0 degree) are formed at the intersection between the x-direction part 1x and y-direction part 1y of the dielectric core 1. Also, in the lower layer Lc part, as shown in 6(D), protrusions Pe2 are formed in the same direction. In the middle layer Lb part, as shown in 6(*a*) and 6(C), protrusions Pc protruding in the direction of y−x (in the direction having a direction angle of 135° assuming that the x direction is 0 degree) and in the direction of x−y (in the direction having a direction angle of −45° assuming that the x direction is 0 degree) are formed, respectively.

Figure 6A:
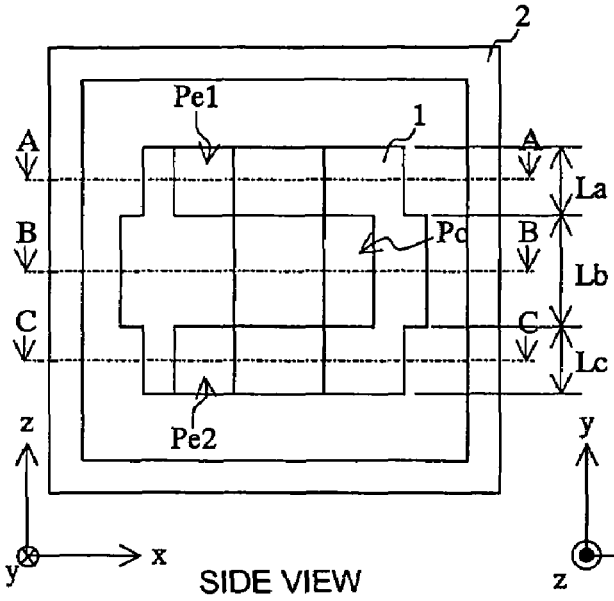
FIGS. 6A to 6D are diagrams illustrating a cross-sectional shape of each layer of the dielectric core in the cavity.
Figure 6B:
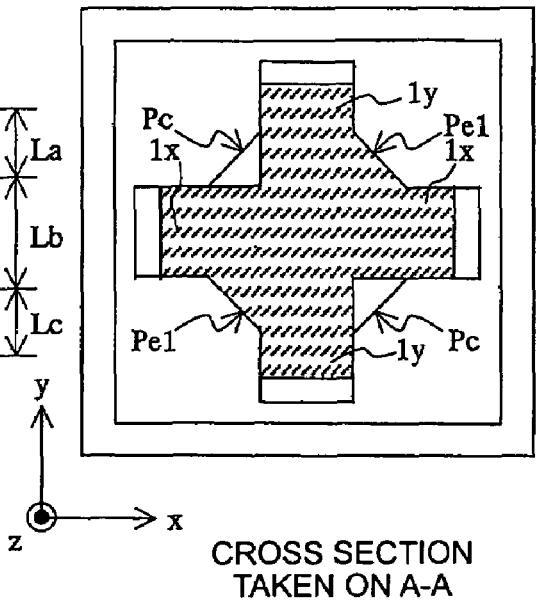
Figure 6C:
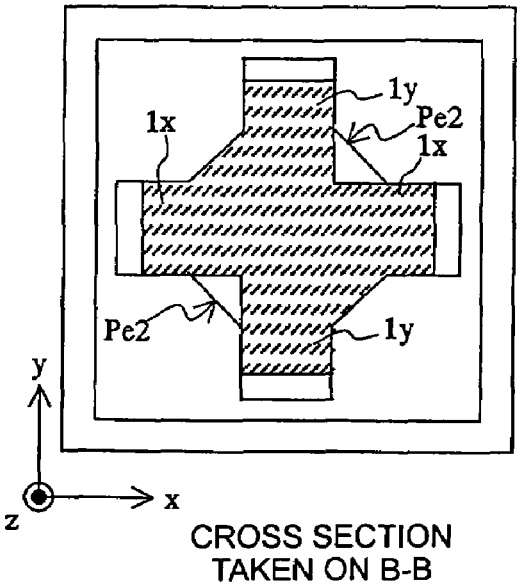
Figure 6D:
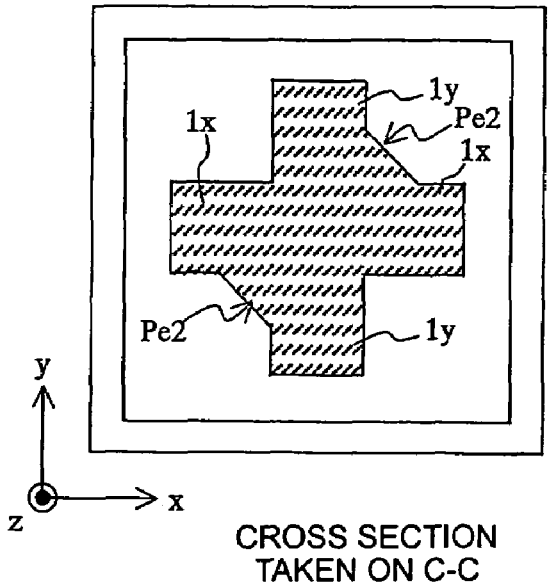
Figure 7A:
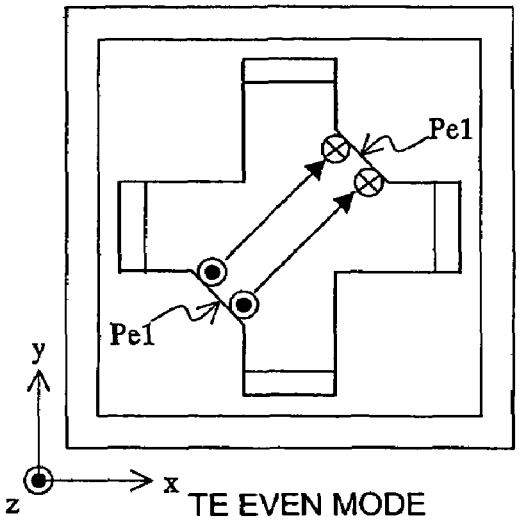
FIGS. 7A to 7D are diagrams illustrating the effect of a protrusion of the TE coupling on an TE coupling mode and an TM coupling mode.
Figure 7B:
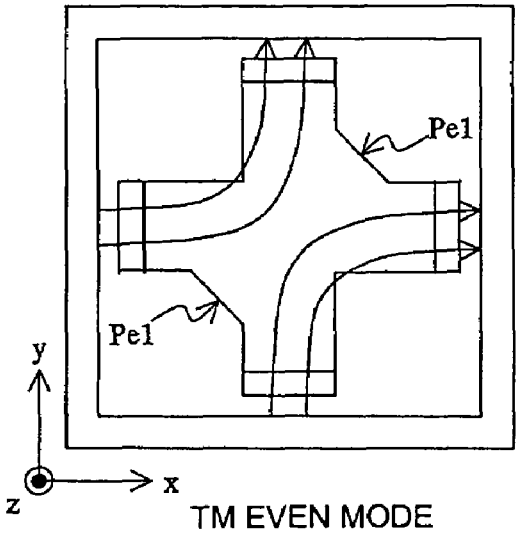

FIGS. 7(A) to 7(D) show electric flux distribution of two coupling modes (TE coupling modes) by the TE01δ_x mode and the TE01δ_y mode when the dielectric core 1 having the structure shown in FIG. 6(A) is used. FIGS. 7(A) and 7(B) show an even-mode electric flux distribution and an odd-mode electric flux distribution, respectively. In this case, the protrusions Pe1 of the dielectric core operate to increase the effective dielectric constant of the part through which an even-mode electric flux passes. This is also applied to the operation provided by the protrusions Pe2 of the lower layer shown in FIG. 6. As a result, the resonant frequency of the even mode decreases, and thus a difference with the resonant frequency of the odd mode occurs to couple the TE01δ_x mode and the TE01δ_y mode.

Figure 7C:
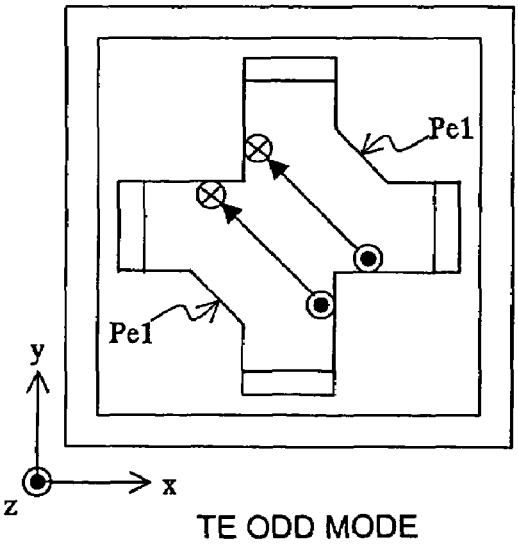
Figure 7D:
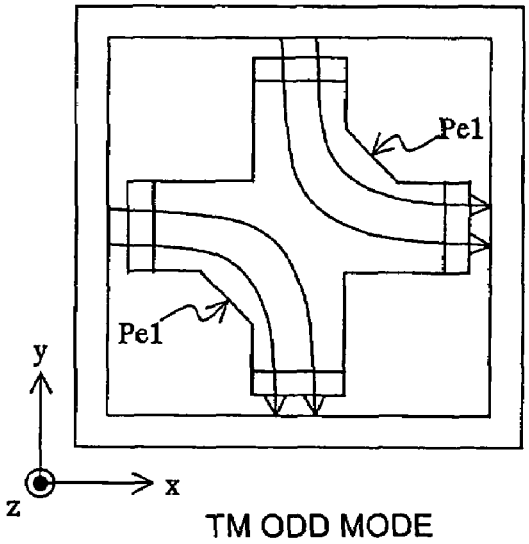

On the other hand, FIGS. 7(B) and 7(D) shows electric flux distribution of two coupling modes (TM coupling modes) by the TM01δ_x mode and the TM01δ_y mode. FIGS. 7(B) and 7(D) show an even-mode electric flux distribution and an odd-mode electric flux distribution, respectively. Here, the protrusions Pe1 operate to increase the effective dielectric constant of the part through which an odd-mode electric flux passes. This is also applied to the operation provided by the protrusions Pe2 disposed on the lower layer. Accordingly, the resonant frequency of the odd mode decreases, and thus a difference with the resonant frequency of the even mode occurs to couple the TM01δ_x mode and the TM01δ_y mode.

On the other hand, FIG. 7(C) shows electric flux density distribution of two coupling modes (TM coupling modes) by the TM01δ_x mode and the TM01δ_y mode. (C) and (D) show an even-mode electric flux density distribution, respectively. Here, the protrusions Pe1 operate to increase the effective dielectric constant of the part of the part through which an odd-mode electric flux passes. This also applies too the operation provided by the protrusions Pe2 disposed on the lower layer. Accordigly, the resonant frequency of the odd mode decreased, thereby creating a gap from the resonant frequency of the even mode and coupling the TM01δ_x mode and the TM01δ_y mode.

However, protrusions Pc are disposed on the middle part of the dielectric core 1 shown in FIG. 6(A). These protrusions Pc protrude in 90°-different directions with an z-axis as center with respect to the protruding directions of the upper layer protrusions Pe1 and the lower layer protrusions Pe2. These protrusions Pc operate in the direction to decrease the resonant frequency of the even mode of the TM coupling mode contrary to the case shown in FIGS. 7(C) and 7(D). As a result, it is possible to make the resonant frequencies of the even mode and the odd mode of the TM coupling mode equal by determining the amount of the protrusions Pe1, Pe2, and Pc. That is to say, it is possible to restrain the coupling of the TM01δ_x mode and the TM01δ_y mode. Although the protrusions Pc of the dielectric core 1 also give some influence on the TE coupling mode, however, they give smaller influence than that on the TM coupling mode, because the electric flux density of the TE coupling mode is relatively higher in the upper part and the lower part than in the middle part of the dielectric core. Accordingly, the protrusions Pc have almost no influence on the amount of coupling between the TE01δ_x mode and the TE01δ_y mode.

Taking an advantage of this effect, the amount of the coupling between the TM01δ_x mode and the TM01δ_y mode can be determined independently of the coupling between the TM01δ_x mode and the TM01δ_y mode by determining the amount of the protrusions Pe1, Pe2, and Pc of the dielectric core 1.

Here, examples of the changes of the resonant frequency and coupling coefficient of each resonant mode when the amount of the protrusions of the protruding portions disposed at the intersection between the x-direction part and y-direction part of the dielectric core 1 are shown in FIGS. 8 and 9. FIG. 8(C) is an example where protrusions P of the dielectric core are formed in the same directions, as shown in FIGS. 8(A) and 8(B), in any of the upper layer, the middle layer, and the lower layer of the dielectric core 1, and the amount of protrusions is changed. Here, KM denotes a coupling coefficient between the TM01δ_x mode and the TM01δ_y mode; KE denotes a coupling coefficient between the TM01δ_x mode and the TM01δ_y mode; TEo denotes a frequency of the odd mode of the TE coupling mode; TEe denotes a frequency of the even mode of the TE coupling mode; TMo denotes a frequency of the odd mode of the TM coupling mode; TMe denotes a frequency of the even mode of the TM coupling mode.

As described above, as the length (the amount of protrusion is expressed by the length of a side) of the protrusion P increases, the amount of coupling of the TE modes with each other increases as well as the amount of coupling of the TM modes with each other simultaneously.

Figure 8A:
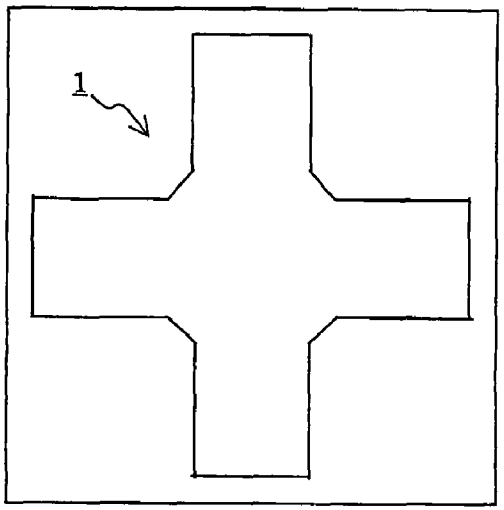
FIGS. 8A to 8D are diagrams illustrating a relationship between the amount of protrusion of a protrusion portion P disposed in the dielectric core 1 and the resonant frequency and the coupling factor of each mode.
Figure 8B:
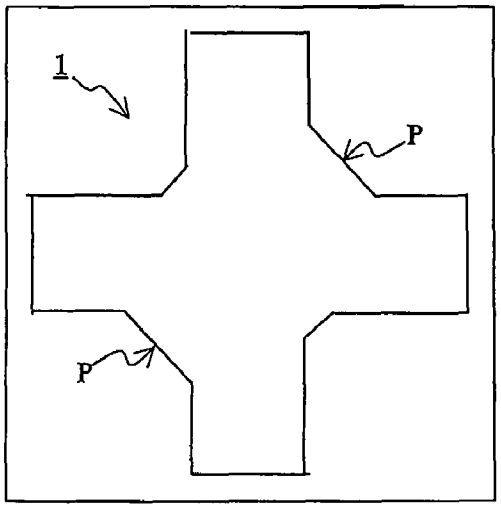
Figure 8C:
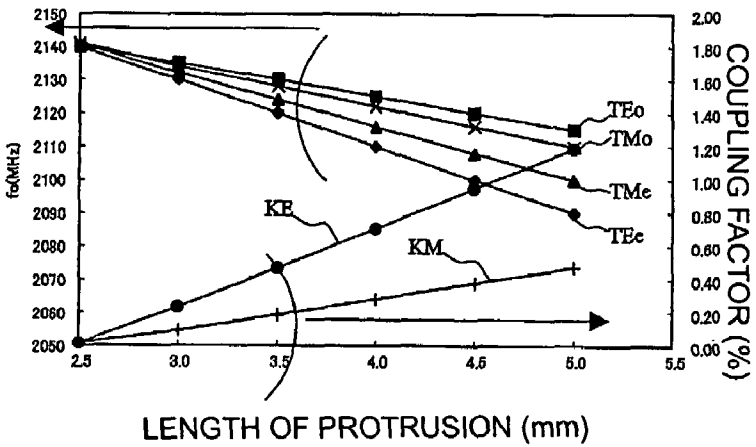
Figure 8D:
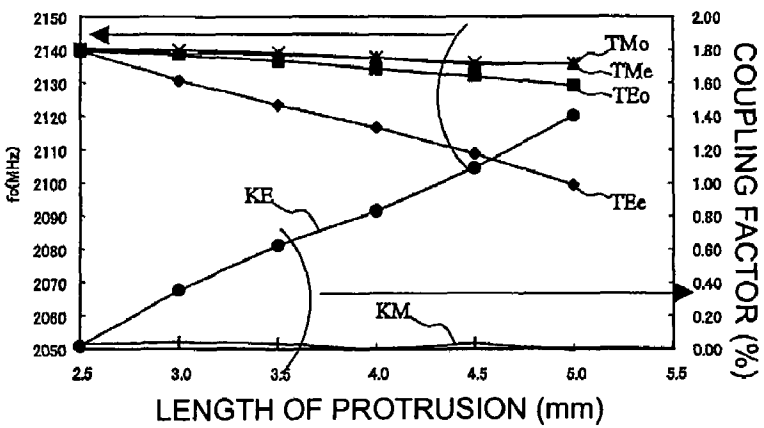
Figure 9A:
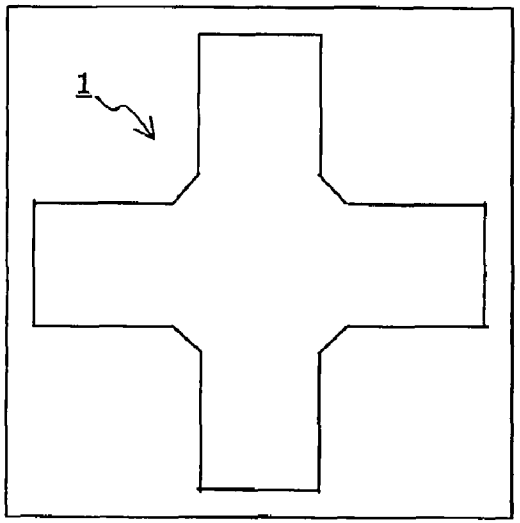
FIGS. 9A to 9D are diagrams illustrating relationships between the amount of protrusion of a protrusion portion P and the amount of subsidence of a subsidence portion S disposed in the dielectric core 1.
Figure 9B:
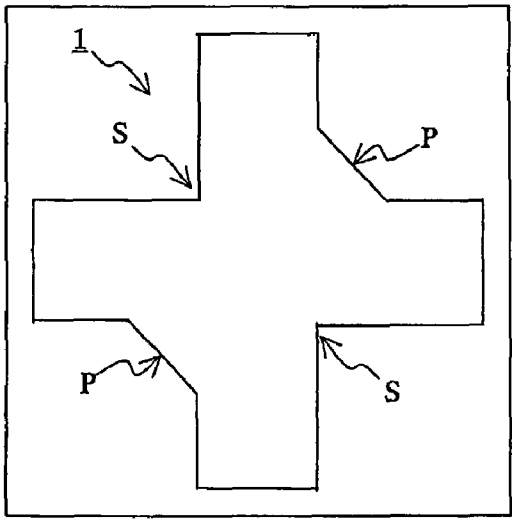
Figure 9C:
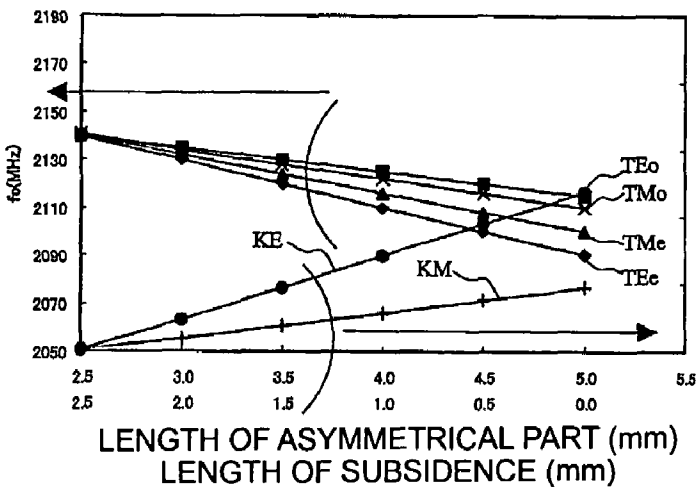
Figure 9D:
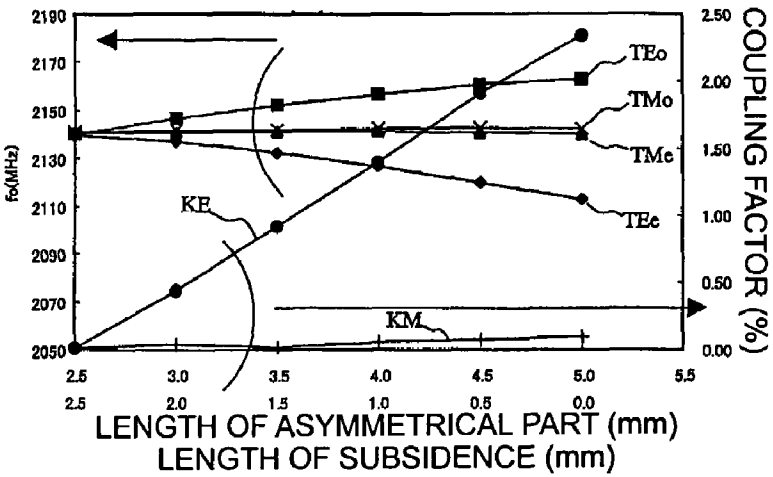

FIG. 8(D) shows a characteristic in the situation where the protrusions P protrude in the same direction, as shown in FIGS. 8(A) and 8(B), in the upper layer and the lower layer of the dielectric core 1, whereas the protrusions P in the middle layer of the dielectric core 1 are formed at 90° different directions so that the KM becomes substantially zero. In (C), as the amount of the protrusions of the protrusion P of the dielectric core 1 increases, the resonant frequency of any of TEx, TEy, TMx, and TMy decreases. In contrast, in (D), the frequencies of the TMo and TMe become almost constant. That is to say, the TM01δ_x mode and the TM01δ_y mode do not couple.

FIG. 9 shows an example where, as shown in (A) and (B), protrusions P are disposed at the 180° rotationally opposite positions of the dielectric core 1 around the z-axis (in the direction perpendicular to the page surface) and subsidences S are disposed at the 90° rotational positions around the z-axis. (C) of FIG. 9 shows a characteristic in the case where protrusions P and subsidences S are disposed on any of the upper layer, the middle layer, and the lower layer of the dielectric core 1 in the same directions. (D) shows a characteristic in the case where protrusions P and subsidences S of the upper and the lower layers of the dielectric core 1 are disposed in the same directions, whereas those of the middle layer are disposed at the 90° different directions, and the amount of the protrusions of the protrusion P and the amount of the subsidences of the subsidence S on the middle layer are determined such that the KM becomes substantially zero.

By forming the protrusions and the subsidences in this manner, KE can be made large as shown in (D), and TEe decreases as TEo increases. Accordingly, the coupling coefficients of both modes can be determined while keeping each of the frequencies of the basic modes (the TM01δ_x mode and the TM01δ_y mode) substantially constant. Thus, it becomes easy to adjust only the coupling coefficient independently of the resonant frequency.

Figure 10A:
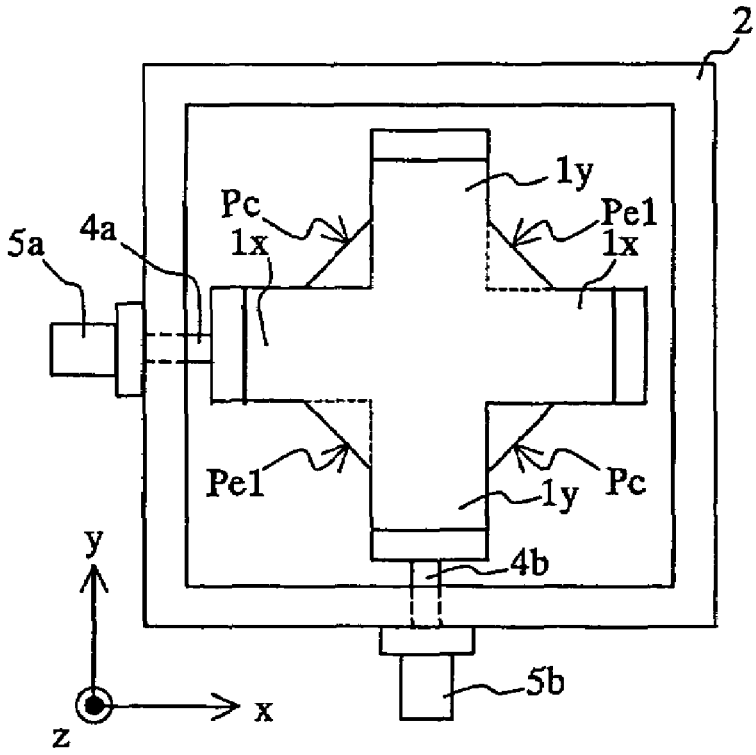
FIGS. 10A and 10B are diagrams illustrating the configuration of a dielectric filter.
Figure 10B:
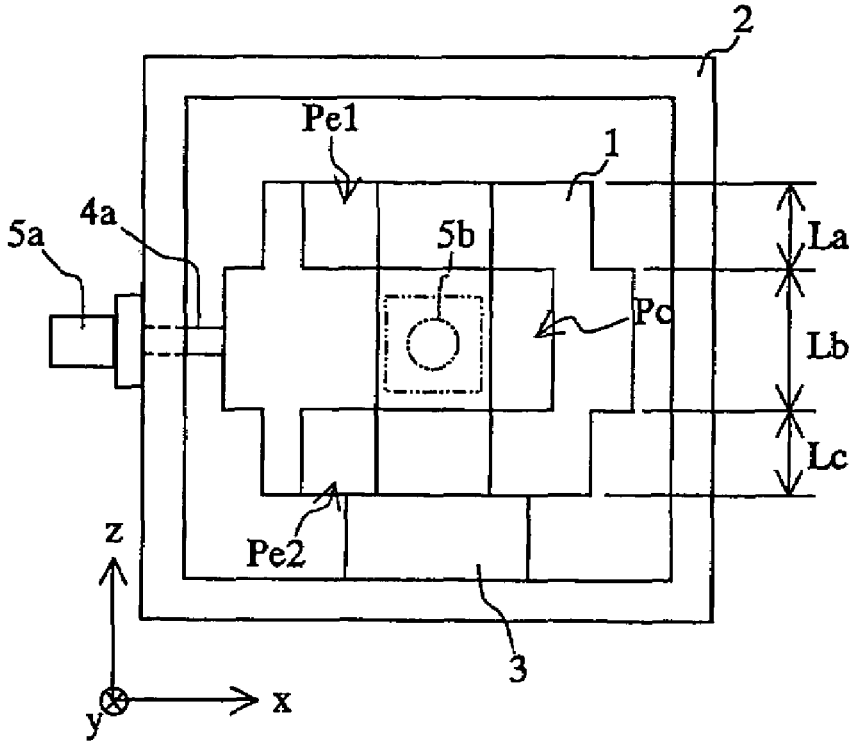

FIG. 10 is an example in which a dielectric filter consisting of the four-stage resonators utilizing the above-described four resonant modes is constructed. (A) is a plan view with the top surface of the cavity is removed; (B) is a front view with the near-side wall surface of the cavity 2 removed. In FIG. 10, the dielectric core 1 is fixed by adhesion to the central part of the bottom surface of the cavity 2 through a support table 3 having a low dielectric constant. Thus, the dielectric core 1 is disposed substantially at the center of the cavity 2. Coaxial connectors 5*a*, 5*b* are attached to the cavity 2, and the central conductor thereof projects into the inside of the cavity 2 as input/output probes 4*a*, 4*b*. The probe 4*a* is coupled, through electric field, to the TM01δ_x mode whose electric flux mainly passes the dielectric core 1 in the x direction. The probe 4*b* is coupled, through electric field, to the TM01δ_y mode whose electric flux mainly passes the dielectric core 1 in the y direction.

The coupling between the TM01δ_x mode and the TM01δ_y mode and the coupling between the TM01δ_x mode and the TM01δ_y mode shown in FIG. 5 are performed by displacing the height of the middle-layer part Lb having a high TM mode electric flux density of the dielectric core 1 upward or downward from the middle height. That is to say, the balance of the electric field strength of the TM01δ_x mode and the TM01δ_y mode in the vertical direction collapses, and thus energy moves from the TM01δ_x mode to the TM01δ_y mode to produce the coupling between the both modes. Similarly, energy moves from the TM01δ_x mode to the TM01δ_y mode to produce the coupling between the both modes.

In this manner, the dielectric resonator device operates as a dielectric filter that is equipped with the four-stage resonators and has a band-pass characteristic.

In this regard, the center of the electric flux distribution of the TM01δ_x mode and the TM01δ_y mode can also be displaced upwardly or downwardly by displacing the position of the probes 4*a*, 4*b* shown in FIG. 10 in the vertical direction (the z-axis direction) upwardly or downwardly from the middle height of the dielectric core 1, thereby coupling the TM01δ_y mode and the TM01δ_x mode.

Figure 11A:
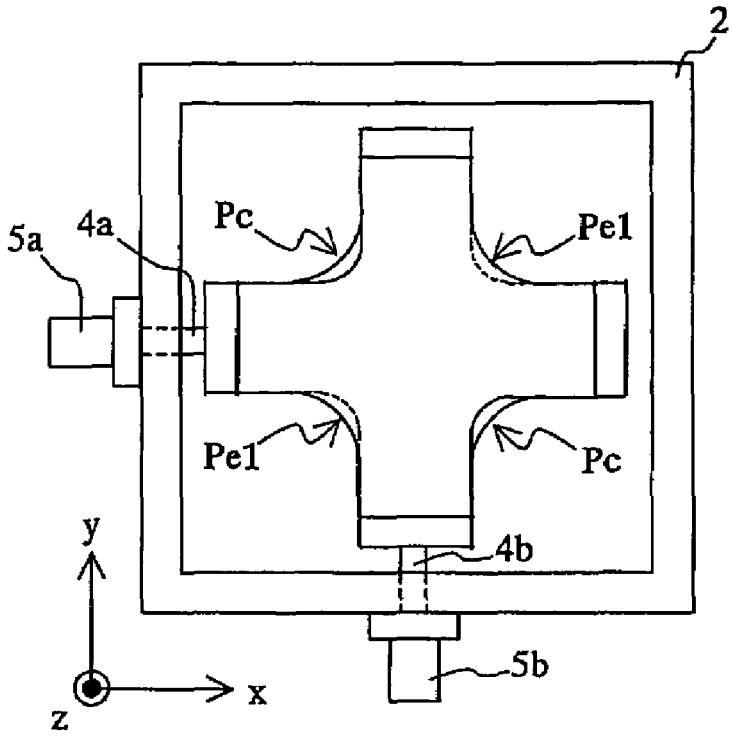
FIGS. 11A and 11B are diagrams illustrating the configuration of a dielectric filter according to a second embodiment.
Figure 11B:
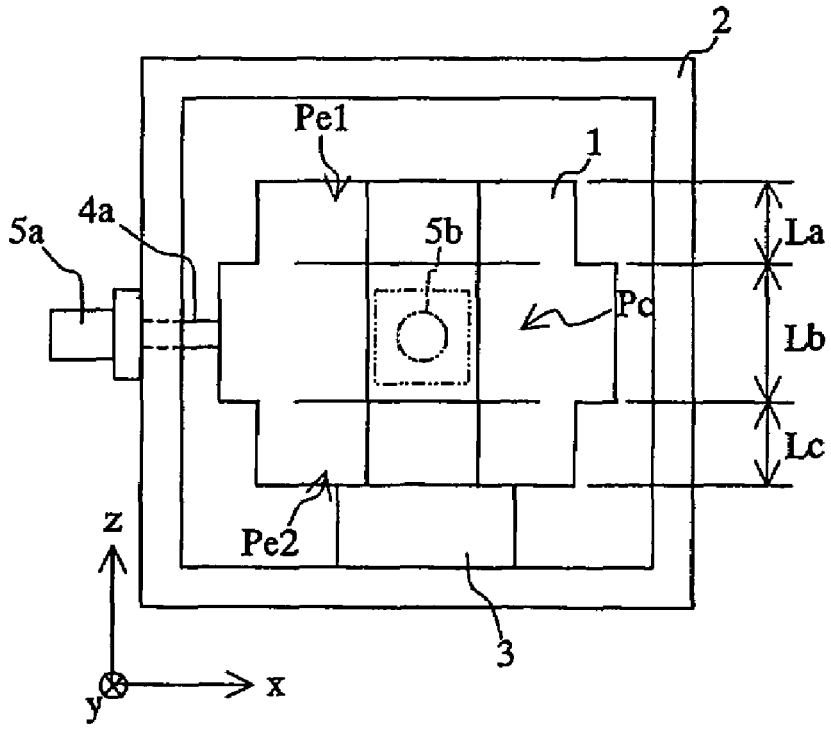

Next, the structure of a dielectric filter according to a second embodiment is shown in FIG. 11. Here, protrusions Pe1, Pe2 for the TE coupling of the dielectric core 1 are fillet-shaped. Also, protrusions Pc for restraining the TM coupling are fillet-shaped. In this regard, portions which do not protrude positively (90° rotated positions of Pe1, Pe2, and Pc around the z-axis) are also fillet-shaped such that the dielectric core 1 becomes difficult to crack. The structure is the same as that shown by the first embodiment for the other portions. Accordingly, as in the first embodiment, the dielectric resonator device operates as a dielectric filter that is equipped with the four-stage resonators and has a band-pass characteristic.

Figure 12A:
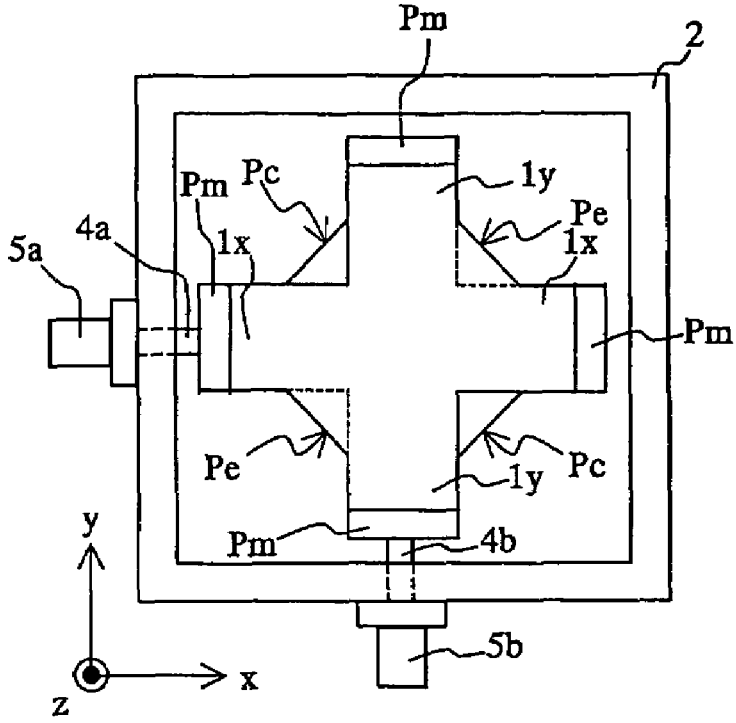
FIGS. 12A and 12B are diagrams illustrating the configuration of a dielectric filter according to a third embodiment.
Figure 12B:
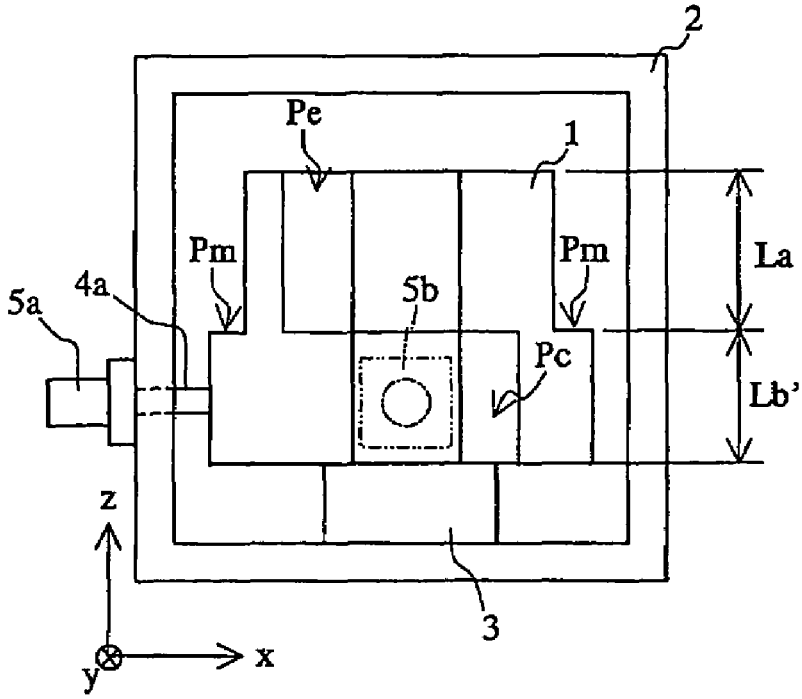
Figure 13A:
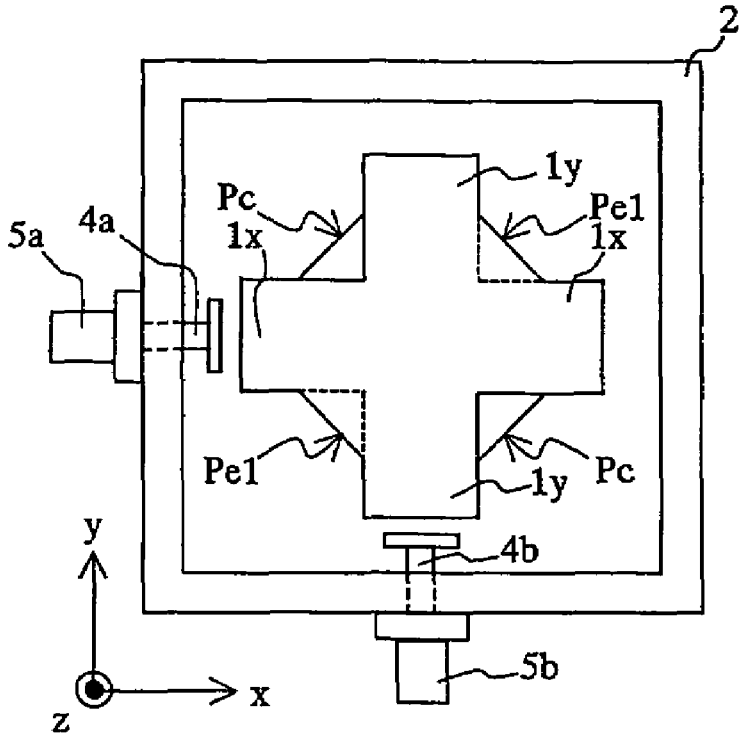
FIGS. 13A and 13B are diagrams illustrating the configuration of another dielectric filter according to the third embodiment.
Figure 13B:
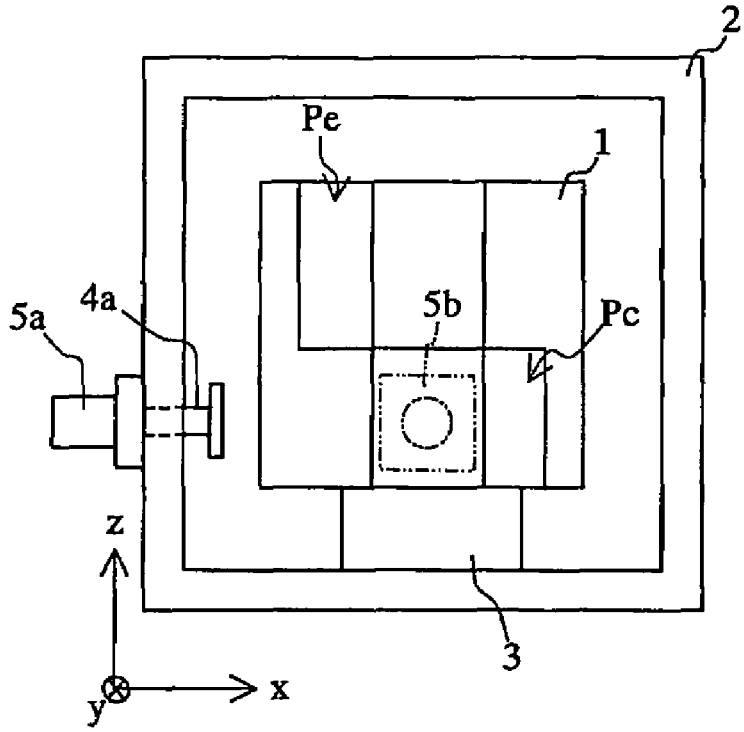

FIGS. 12 and 13 are diagrams illustrating the configuration of a dielectric filter according to a third embodiment. (A) of FIG. 12 is a plan view of the dielectric core 1 in the cavity 2 and (B) is a front view of the same dielectric core 1. This dielectric core 1 has a structure equal to the structure in which the middle-layer part Lb of the dielectric core 1 shown in FIG. 10 shifted to the lowermost to eliminate the lower-layer part Lc in order to have a two-layer structure consisting of an upper-layer part La and a lower-layer part Lb'. Accordingly, the probes 4*a*, 4*b* are also disposed in the central part of the lower-layer part Lb' of the dielectric core 1. Even with this two-layer structure, the TM01δ_x mode and the TM01δ_y mode can be coupled by the protrusion of the protrusions Pe for TE coupling, and the coupling between the TM01δ_x mode and the TM01δ_y mode can be restrained by the protrusion of the protrusions Pc for restraining the TM coupling. Accordingly, the dielectric resonator device also operates as a dielectric filter consisting of the four-stage resonators and having a band-pass characteristic.

In the example shown in FIG. 12, protrusions Pm are disposed on the dielectric core 1 for the TM01δ mode. However, the excitation and the external coupling of the TM01δ mode can be performed without disposing dielectric core protrusions Pm, as shown in FIG. 13. At that time, as shown in FIG. 13, it is possible to increase independence in the dielectric core 1 of the electric flux of the TM01δ mode passing through the dielectric core 1 by disposing a flat surface part, which faces the dielectric core 1, on each of the probe 4*a* and 4*b*.

Figure 14A:
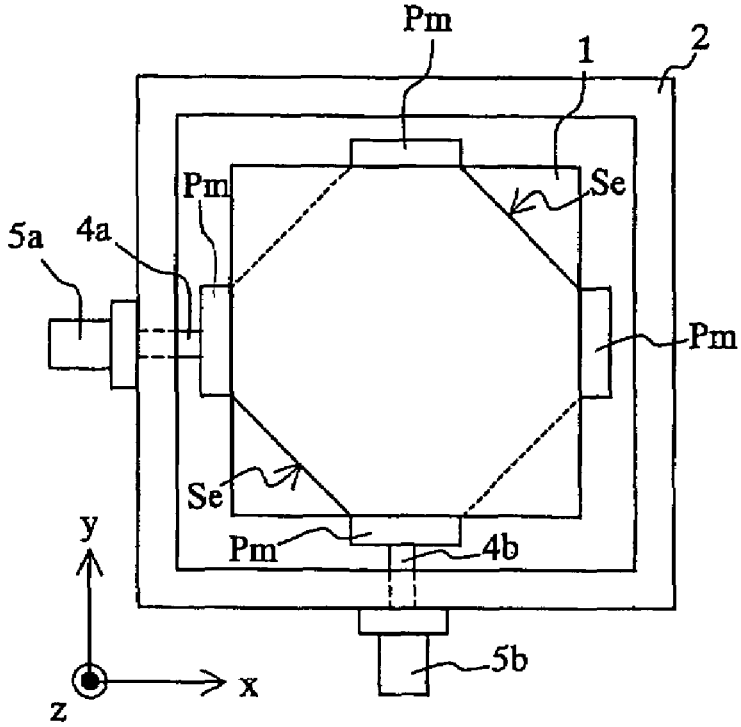
FIGS. 14A and 14B are diagrams illustrating the configuration of a dielectric filter according to a fourth embodiment.
Figure 14B:
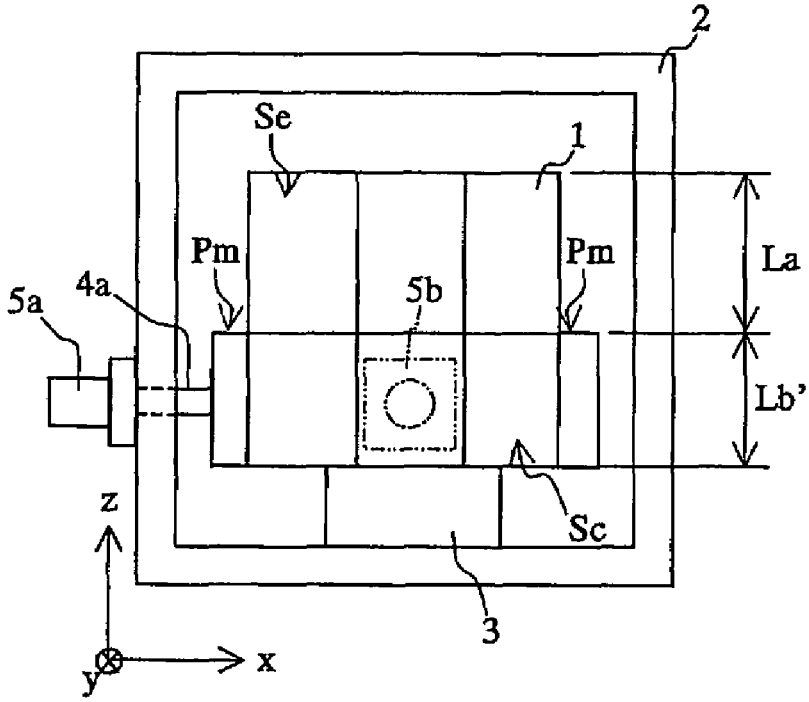
Figure 15A:
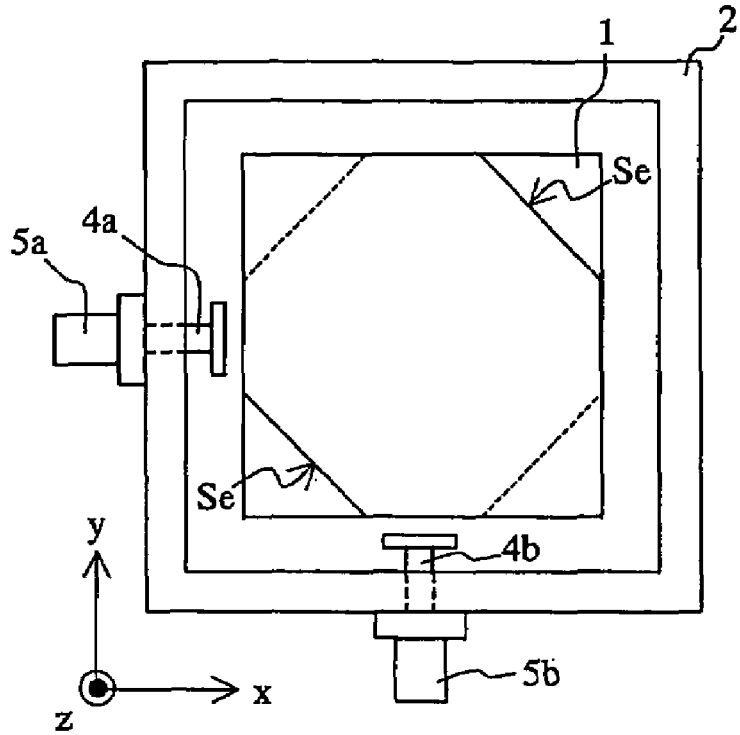
FIGS. 15A and 15B are diagrams illustrating the configuration of another dielectric filter according to the fourth embodiment.
Figure 15B:
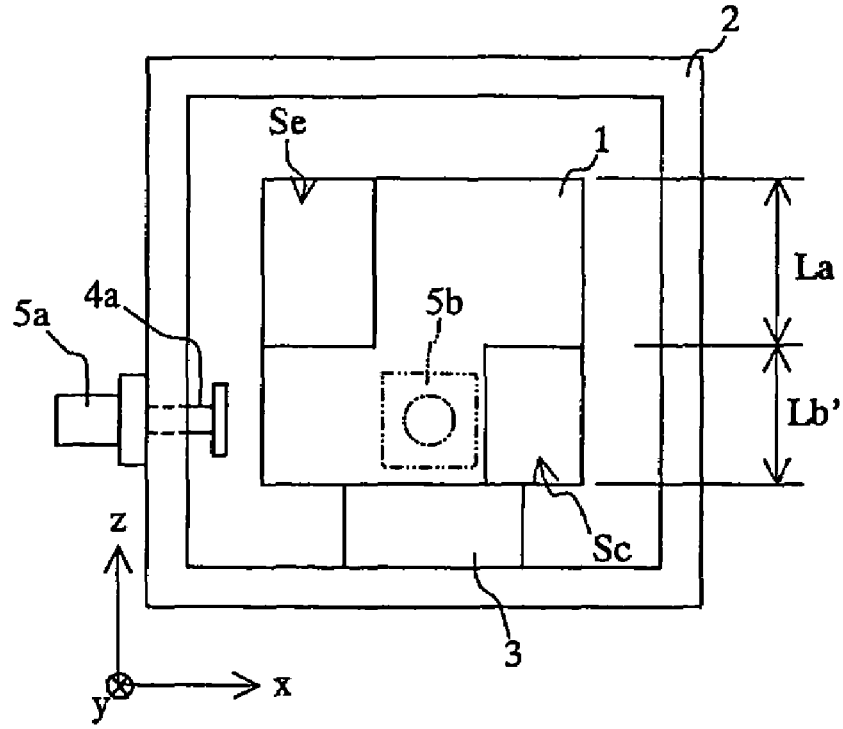

FIGS. 14 and 15 show the structure of a dielectric filter according to a fourth embodiment. In both figures, (A) is a plan view of the dielectric core 1 inside the cavity 2 and (B) is a front view thereof. The dielectric core 1 used in the dielectric filter according to the fourth embodiment has an outer cubic shape with subsidences Se on its upper layer part La and subsidences Sc on its lower-layer part Lb'. The subsidences Se formed on the upper-layer part La of the dielectric core 1 creates a difference in the resonant frequencies of the even mode and the odd mode of the TE coupling mode, thereby coupling the TM01δ_x mode and the TM01δ_y mode. Also, the subsidences Sc formed on the lower-layer part Lb operates to suppress the shift of the frequencies of the even mode and the odd mode of the TM coupling mode that is caused by the presence of the above-described subsidences Se. Accordingly, it is possible to suppress the coupling between the TM01δ_x mode and the TM01δ_y mode by balancing the subsidences Se and Sc.

The example shown in FIG. 15 is the case where the protrusions Pm for the TM01δ mode formed on the dielectric core 1 in FIG. 14, is eliminated. Using such a dielectric core, the dielectric resonator device operates as a dielectric filter, in the same manner, in which the four-stage resonators are coupled in sequence and which has a band-pass characteristic.

Figure 16A:
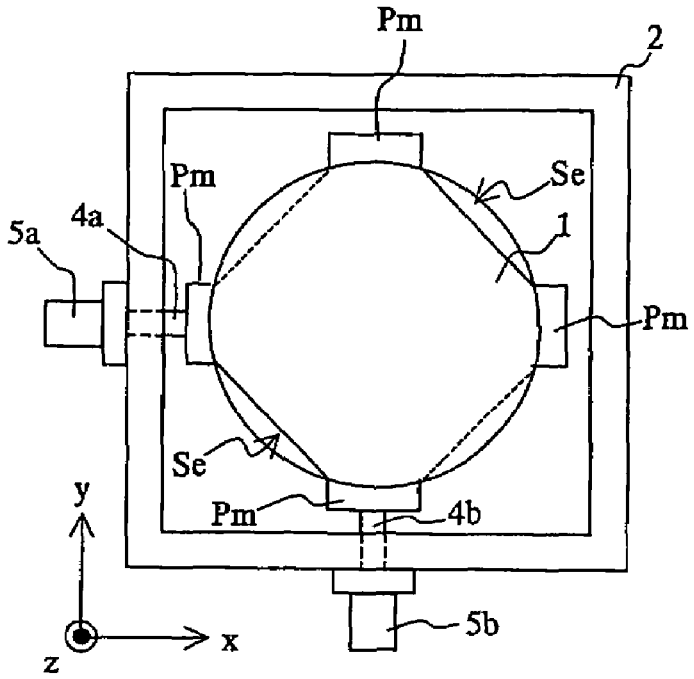
FIGS. 16A and 16B are diagrams illustrating the configuration of a dielectric filter according to a fifth embodiment.
Figure 16B:
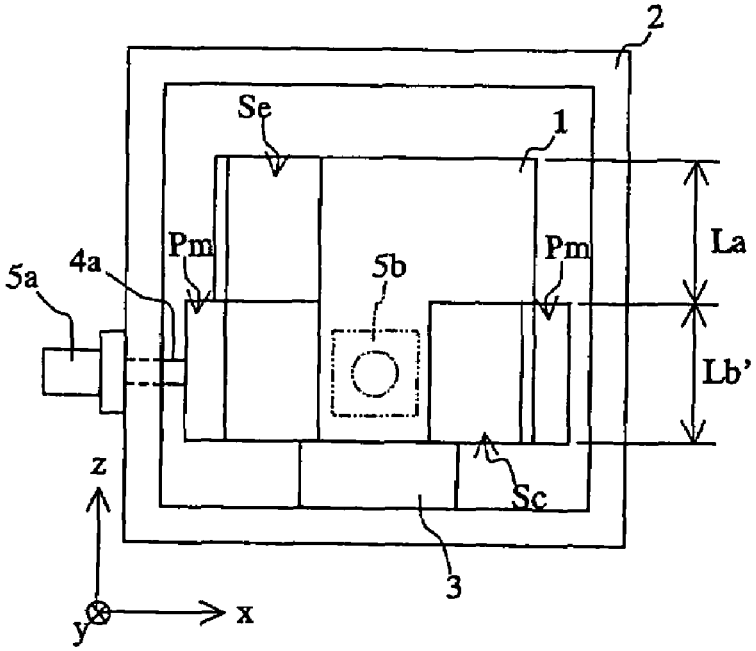
Figure 17A:
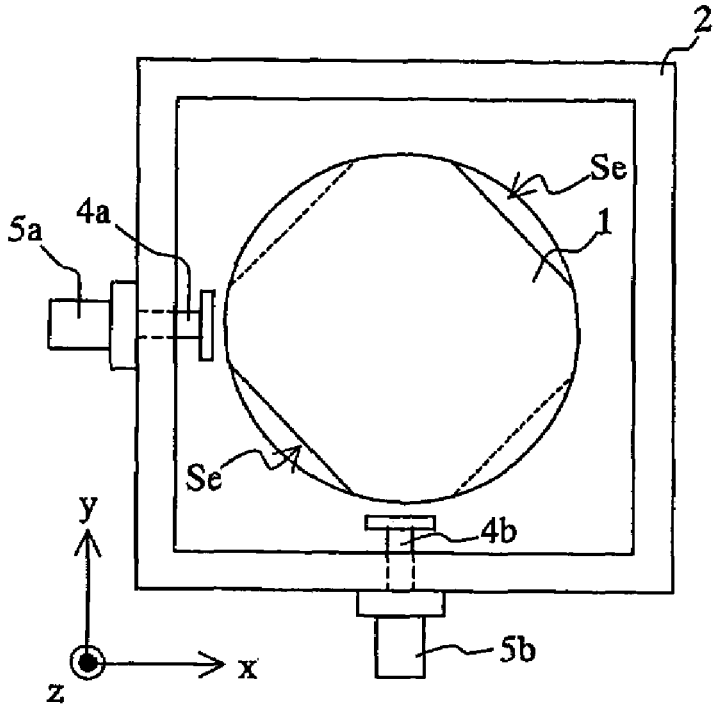
FIGS. 17A and 17B are diagrams illustrating the configuration of another dielectric filter according to the fifth embodiment.
Figure 17B:
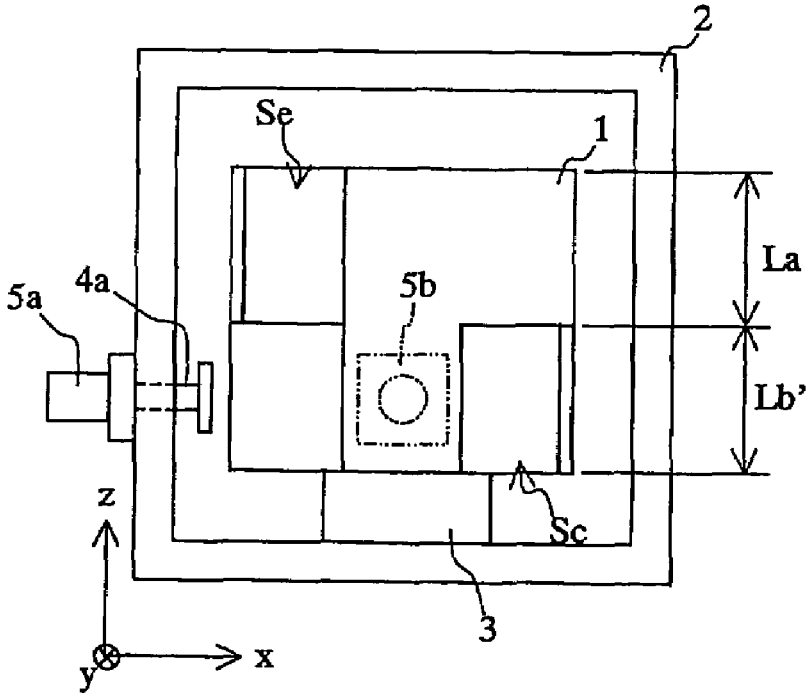

FIGS. 16 and 17 are diagrams illustrating the structure of a dielectric filter according to a fifth embodiment. The dielectric core 1 used in this dielectric filter is equal to a structure in which a dielectric core 1 shown in FIG. 14 is modified to have a cylindrical shape. That is to say, the dielectric core 1 has a substantially cylindrical shape as a whole, forming subsidences Se for the TE coupling on the upper-layer part La, and subsidences Sc for restraining the TM coupling on the lower-layer part Lb'. Also, FIG. 17 is equal to a structure in which the dielectric core protrusions Pm in FIG. 16 are removed. Even using such forms, the dielectric resonator device also operates as a dielectric filter consisting of four-stage resonators and having a band-pass characteristic.

Figure 18A:
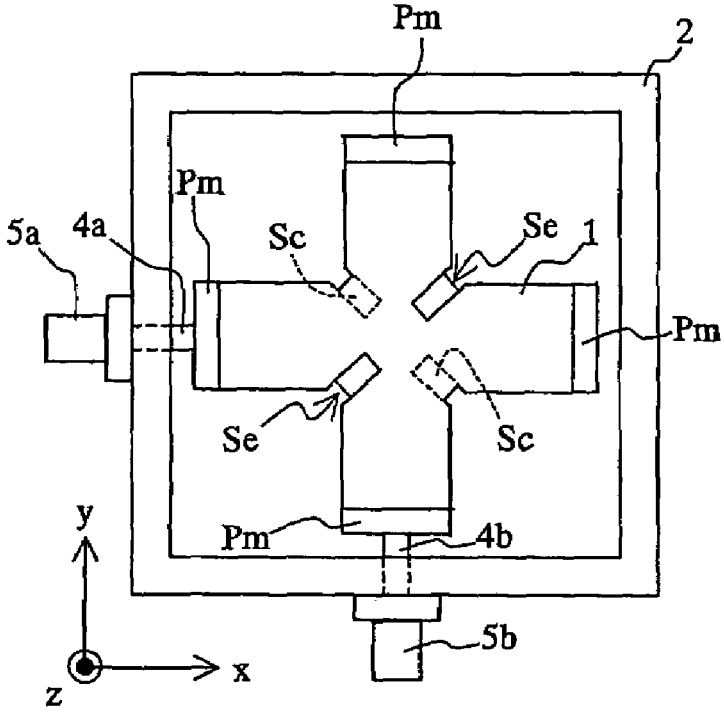
FIGS. 18A and 18B are diagrams illustrating the configuration of a dielectric filter according to a sixth embodiment.
Figure 18B:
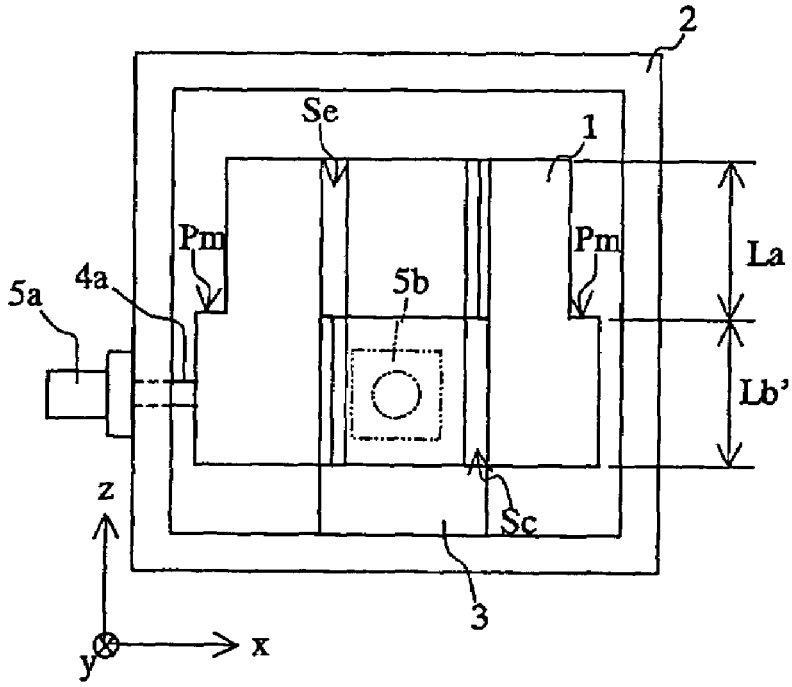

FIG. 18 is a diagram illustrating the configuration of a dielectric filter according to a sixth embodiment. In this example, the dielectric core 1 is cross-shaped in its plan view, and forms subsidences Se for the TE coupling on the upper-layer part La, and subsidences Sc for restraining the TM coupling on the lower-layer part Lb'. Since the subsidences Se cause a difference in the resonant frequencies of the even mode and the odd mode of the TE coupling mode, the TM01δ_x mode and the TM01δ_y mode are coupled by subsidences Se. Also, the subsidences Sc formed on the lower-layer part Lb operate to restrain the shift of the frequencies of the even mode and the odd mode of the TM coupling mode. Accordingly, it is possible to restrain the coupling between the TM01δ_x mode and the TM01δ_y mode by balancing the subsidences Se and Sc.

Using such a dielectric core, the dielectric resonator device also operates, in the same manner, as a dielectric filter in which the four-stage resonators are coupled in sequence and which has a band-pass characteristic.

Figure 19A:
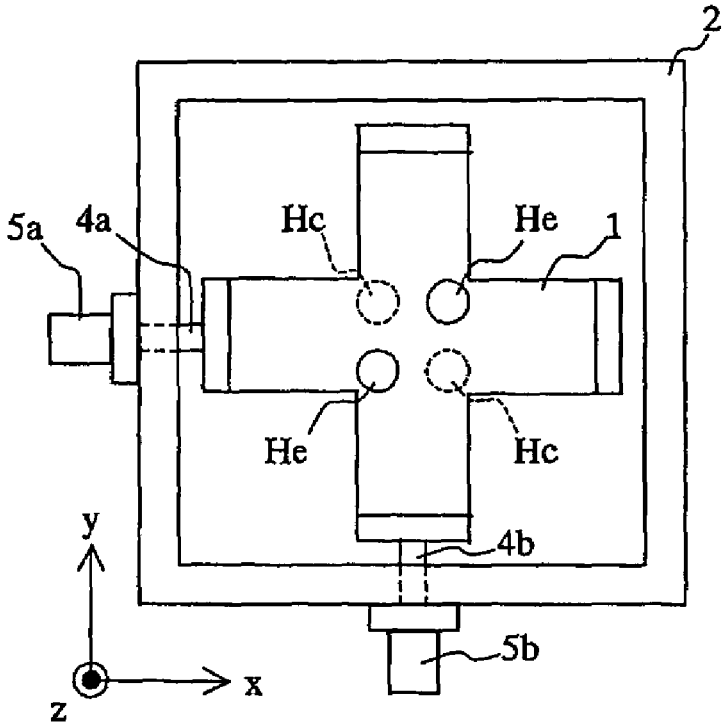
FIGS. 19A and 19B are diagrams illustrating the configuration of a dielectric filter according to a seventh embodiment.
Figure 19B:
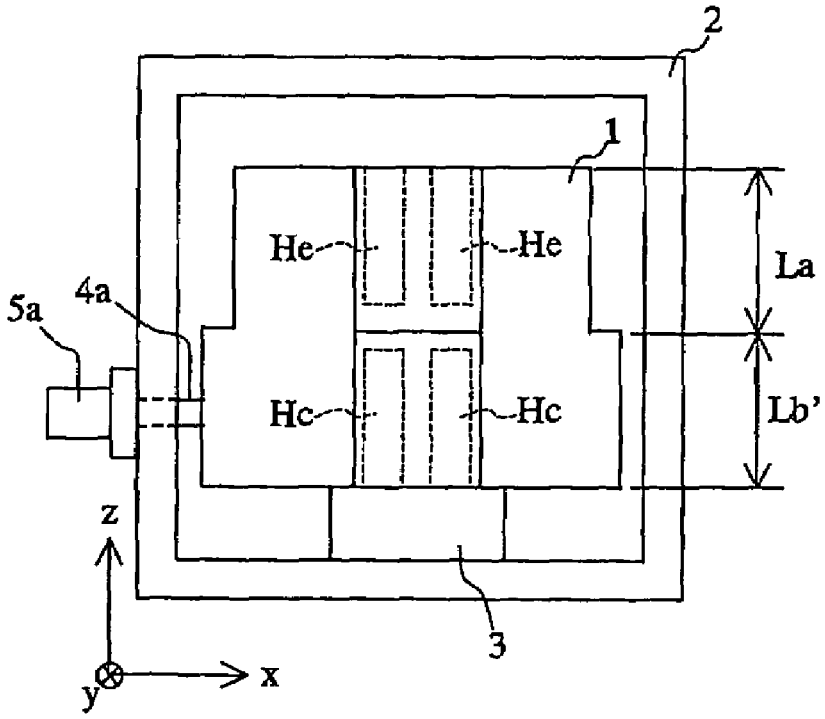

FIG. 19 is a diagram illustrating the configuration of a dielectric filter according to a seventh embodiment. In this example, holes He for the TE coupling are formed in the upper layer part of the dielectric core 1 and holes Hc for restraining the TM coupling are formed on the lower-layer part. In this manner, it is possible to cause a difference in effective dielectric constants of the individual parts through which the even-mode and odd-mode electric flux of the TE coupling mode pass and to make the effective dielectric constants of the individual parts through which the even-mode and the odd-mode electric flux of the TM coupling mode pass substantially equal, thereby coupling the TM01δ_x mode and TM01δ_y mode without coupling the TM01δ_x mode and TM01δ_y mode.

Figure 20A:
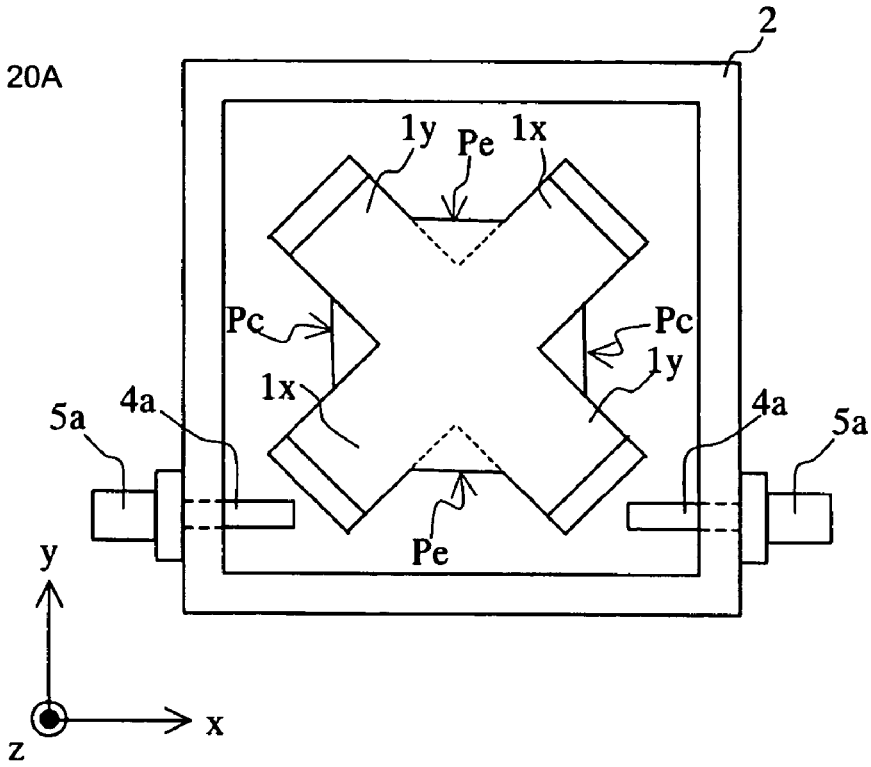
FIGS. 20A and 20B are diagrams illustrating the configuration of a dielectric filter according to an eighth embodiment.
Figure 20B:
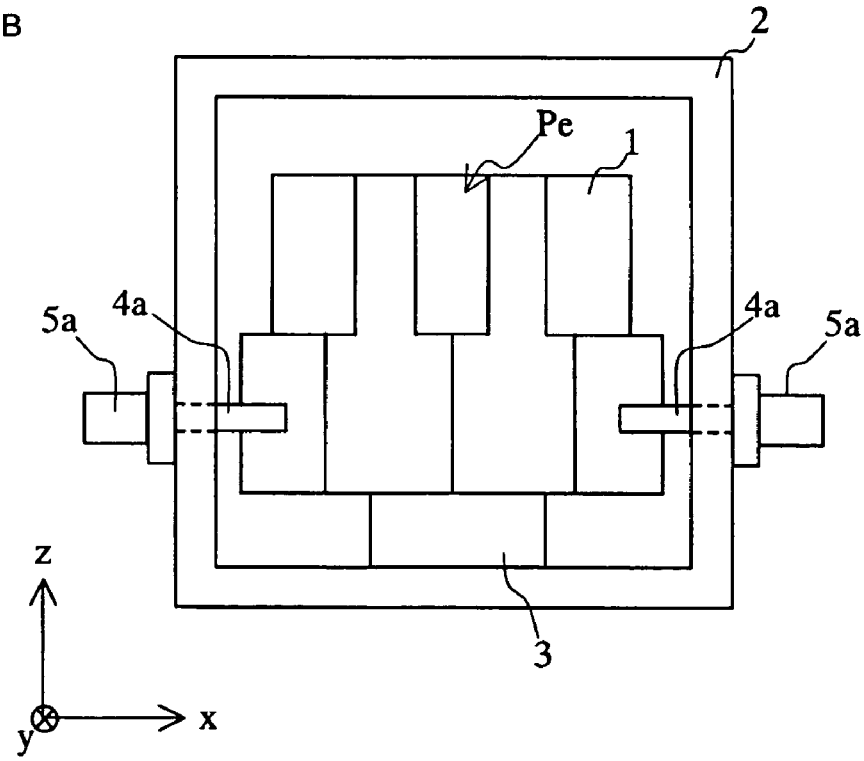

FIG. 20 is a diagram illustrating the configuration of a dielectric filter according to an eighth embodiment. The dielectric core 1 used here is the same as the dielectric core 1 shown in FIG. 12. However, the dielectric core 1 is disposed in a state of being rotated 45° with the z-axis as center inside of the cavity 2. Also, a probe 4*a* is disposed near the end of the x-direction part 1x of the dielectric core and another probe 4*a* is disposed near the end of the y-direction part 1y of the dielectric core in accordance with the above. Note that although the portions of the dielectric core denoted by 1x and 1y are not in the x-direction and y-direction, respectively, the same reference numerals are used in order to correspond to the reference numerals shown in FIG. 12. Here, the TM mode in which electric flux mainly passes through the 1x portion of the dielectric core 1 can be called the TM01δ_(x+y) mode, the TM mode in which electric flux mainly passes through the 1y portion of the dielectric core 1 can be called the TM01δ_(x−y) mode. Further, the TE mode in which electric field rotates in the 1x portion can be called the TE01δ_(x+y) mode, and the TE mode in which electric field rotates in the 1y portion can be called the TE01δ_(x−y) mode.

The TM01δ_(x+y) mode and the TM01δ_(x−y) mode can be coupled by the protrusion of the protrusions Pe for the TE coupling, and the coupling between the TM01δ_(x+y) mode and the TM01δ_(x−y) mode due to the above-described protrusions Pe can be suppressed by the protrusion of the protrusions Pc for the TM coupling suppression. Accordingly, the dielectric resonator device of this example also operates as a dielectric filter consisting of the four-stage resonators and having a band-pass characteristic.

Figure 21:
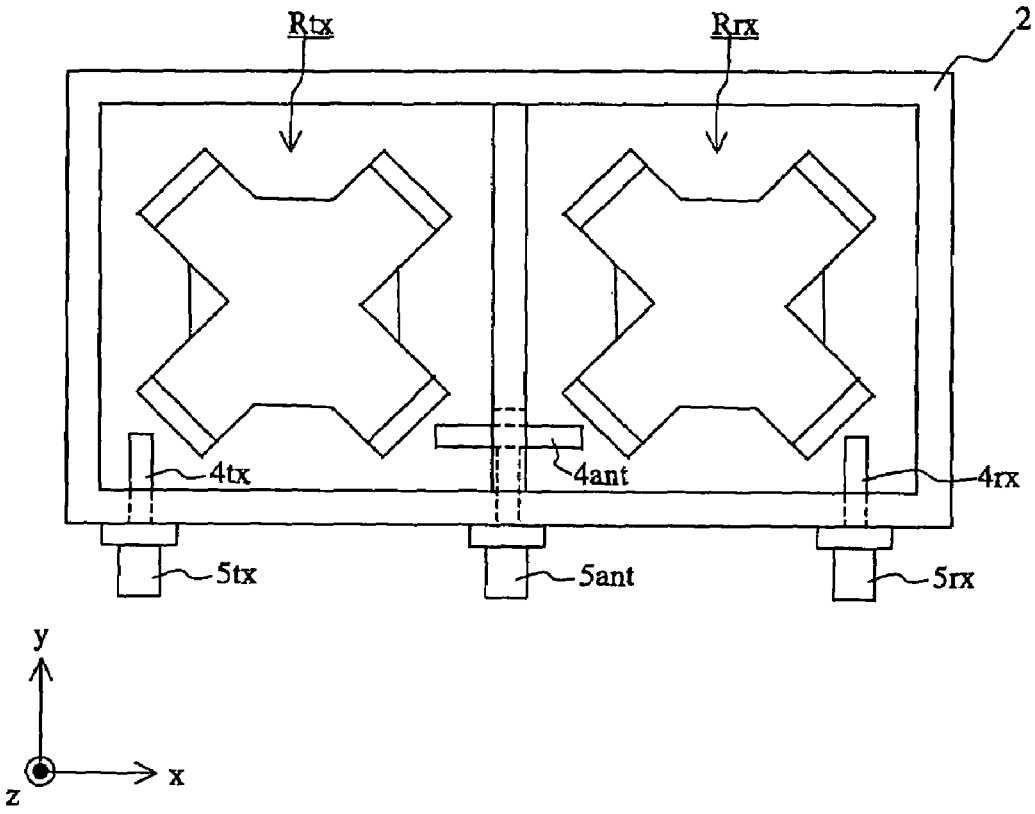
FIG. 21 is a diagram illustrating the configuration of a composite dielectric filter according to a ninth embodiment.

Next, the configuration of a composite dielectric filter is shown in FIG. 21 as a ninth embodiment. Here, the portions denoted as Rtx and Rrx include the dielectric filter shown in FIG. 20, respectively. Probes 4tx, 4rx respectively couple with one of the TM01δ modes of the resonators Rtx, Rrx through an electric field. Also, probe 4ant couples with the other TM01δ mode of the resonators Rtx, Rrx, respectively. Here, the probe 4ant performs a phase adjustment such that a transmission signal does not sneak in the reception filter side and a reception signal does not sneak in the transmission filter side. Here, by setting the frequency of each resonant mode, the composite dielectric filter operates on the whole as a transmitter/receiver with a coaxial connector 5tx as a transmission-signal input part, 5rx as a reception-signal output part, 5ant as an antenna connection part, Rtx as a transmission filter, and Rrx as a reception filter.

Figure 22:
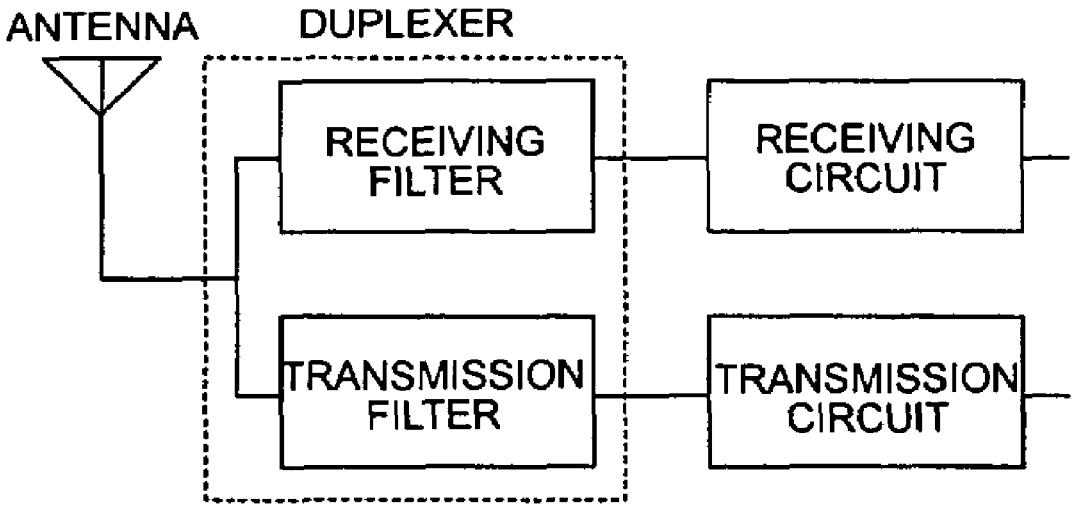
FIG. 22 is a block diagram illustrating the configuration of a communication apparatus according to a tenth embodiment.

Next, the configuration of a communication apparatus according to a tenth embodiment is shown in FIG. 22 as a block diagram. Here, the transmitter/receiver shown in FIG. 21 is used for a duplexer. A transmission circuit and a receiving circuit are connected to the transmission-signal input port and the reception-signal output port of the duplexer, respectively. An antenna is connected to an antenna port. In this manner, a communication apparatus equipped with a multimode dielectric resonator device according to the present invention is constituted.

According to this present invention, a difference in frequency arises between the even-mode and the odd-mode, which are the two coupling modes of the first and the second TM01δ modes, thereby causing the coupling of the first and the second TM01δ modes. Also, no difference in frequency arises between the even-mode and the odd-mode, which are the two coupling modes of the first and the second TM01δ modes or TM011 modes, thereby causing no coupling of the first and the second TM01δ modes or TM011 modes among themselves. That is to say, the coupling of the first and the second TM01δ modes themselves can be set independently of TM modes.

Also, according to this invention, with regard to the even mode and the odd mode of the TE coupling modes, a difference is created in the amount of a protrusion or the amount of a subsidence of the dielectric core portions having electric flux passing therethrough and a subsidence or a protrusion that cancels the frequency changes, caused by said difference, of the even mode and the odd mode of the TM coupling modes is provided in the dielectric core portion having a relatively low electric flux density of the TE coupling mode. Thus, a frequency change of the even mode and the odd mode of the TM coupling mode, which arises from the difference in the amount of protrusion or the amount of subsidence of the dielectric core disposed on the position having a high electric flux density of the TE coupling mode, is canceled, and the coupling of the first and the second TM01δ or TM011 modes themselves can be prevented.

Also, according to this invention, the first and the second TM01δ modes or TM011 modes and the first and the second TM01δ modes are coupled, respectively, by displacing a center of electric flux density distribution of the first and the second TM01δ modes or the first and the second TM011 modes upwardly or downwardly in planes perpendicular to the directions of the electric fields of the first and the second TM01δ modes or the first and the second TM011 modes. At this time, since the coupling does not arise between the first and the second TM01δ modes or the TM011 modes themselves, the first TM01δ mode or TM011 mode→the first TM01δ mode→the second TM01δ mode→the second TM01δ mode or TM011 mode are coupled in sequence, thereby operating as four-stage resonators.

Also, according to this invention, a dielectric filter can be used as a small-sized band-pass filter by providing: a multimode dielectric resonator device operating as the four-stage resonators described above; and external coupling means for external coupling of the first-stage and the last-stage resonators, respectively, of the four-stage resonators.

Also, according to this invention, by providing two sets of the dielectric filters described above and sharing one of the external coupling means of each of the dielectric filters, for example, the dielectric filter can be used as a small-sized transmitter/receiver having one of the filters as a transmission filter, the other of the filters as a reception filter, and the shared external coupling means as an antenna port.

Also, according to this invention, a small-sized communication apparatus having a predetermined high-frequency circuit characteristic can be constituted by providing the above-described dielectric filter or composite dielectric filter in a high-frequency circuit portion.

The invention claimed is:

1. A multimode dielectric resonator device comprising a dielectric core disposed in a cavity, said dielectric core producing a first TM01δ mode or TM011 mode having an electric field directed in a first direction, a second TM01δ or TM011 mode having an electric field directed in a second direction perpendicular to the first direction, a first TE01δ mode having an electric field rotated in a plane perpendicular to the first direction, and a second TE01δ mode having an electric field rotated in a plane perpendicular to the second direction, respectively, wherein individual dielectric core portions having electric flux of an even-mode and an odd-mode of TE coupling mode in the first and the second TE01δ modes passing therethrough have different effective dielectric constants, and individual dielectric core portions having electric flux of an even-mode and an odd-mode of TM coupling mode in the first and the second TM01δ or TM011 mode passing therethrough have substantially equal effective dielectric constants.

2. The multimode dielectric resonator device according to claim 1, wherein the device has at least one protrusion or subsidence and the amount of protrusion or the amount of subsidence of the dielectric core portions having electric flux passing therethrough in even and odd modes of the TE coupling mode are different, and a subsidence or protrusion is disposed on a dielectric core portion having a relatively small electric flux density of the TE coupling mode in an amount to canceling frequency changes between the even mode and the odd mode of the TM coupling mode.

3. A multimode dielectric resonator according to claim 1 wherein the cavity has walls and the dielectric core is spaced from said walls.

4. A multimode dielectric resonator according to claim 1 wherein the dielectric core contacts at least one of said walls.

5. A multimode dielectric resonator according to claim 1 wherein the dielectric core has three layers disposed in an axial direction and the amount or direction or both of the protrusion(s) or subsidence(s) in two of the layers is different.

6. A multimode dielectric resonator according to claim 1 wherein the dielectric core has a cubic shape.

7. A multimode dielectric resonator according to claim 1 wherein the dielectric core has a substantially cylindrical shape.

8. A multimode dielectric resonator according to claim 1 wherein the dielectric core has a cross shape.

9. A multimode dielectric resonator according to claim 1 wherein the amount or direction or both of the protrusion(s) or subsidence(s) in the middle layer is different from that in an outermost layer and that of the two outermost layer are the same.

10. A dielectric filter comprising: a multimode dielectric resonator device according to claim 9; and an external coupler externally coupling the first-stage and the last-stage resonators, respectively, of the four-stage resonators constituting the multimode dielectric resonator device.

11. A composite dielectric filter comprising two dielectric filters according to claim 9 having a shared external coupler.

12. A communication apparatus comprising the composite dielectric filter according to claim 11 in a high-frequency circuit portion.

13. A communication apparatus comprising the dielectric filter according to claim 11 in a high-frequency circuit portion.

14. A multimode dielectric resonator device comprising a four-stage resonators having a first TM01δ mode or TM011 mode, a first TE01δ mode, a second TE01δ mode, and a second TM01δ mode or TM011 mode coupled in sequence, wherein the first and the second TE01δ modes are coupled with the first and the second TM01δ mode or TM011 mode, respectively, by displacing a center of electric field distribution of the first and the second TM01δ modes or the first and the second TM011 modes upwardly or downwardly in planes perpendicular to the directions of the electric fields of the first and the second TM01δ modes or the first and the second TM011 modes.

15. A dielectric filter comprising: a multimode dielectric resonator device according to claim 14; and an external coupler externally coupling the first-stage and the last-stage resonators, respectively, of the four-stage resonators constituting the multimode dielectric resonator device.

16. A communication apparatus comprising the dielectric filter according to claim 15 in a high-frequency circuit portion.

17. A composite dielectric filter comprising two dielectric filters according to claim 14 having a shared external coupler.

18. A communication apparatus comprising the composite dielectric filter according to claim 17 in a high-frequency circuit portion.

* * * * *